US010619101B2

(12) United States Patent
Quanci et al.

(10) Patent No.: US 10,619,101 B2
(45) Date of Patent: Apr. 14, 2020

(54) METHODS FOR DECARBONIZING COKING OVENS, AND ASSOCIATED SYSTEMS AND DEVICES

(71) Applicant: SunCoke Technology and Development LLC, Lisle, IL (US)

(72) Inventors: John Francis Quanci, Haddonfield, NJ (US); Chun Wai Choi, Chicago, IL (US); Mark Ball, Richlands, VA (US); Bradley Thomas Rodgers, Glen Carbon, IL (US); Tony Amadio, Lisle, IL (US); Gary West, Lisle, IL (US); Dwayne Johnson, Naperville, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 957 days.

(21) Appl. No.: 14/587,670

(22) Filed: Dec. 31, 2014

(65) Prior Publication Data

US 2015/0247092 A1 Sep. 3, 2015

Related U.S. Application Data

(60) Provisional application No. 61/922,614, filed on Dec. 31, 2013.

(51) Int. Cl.

| | |
|---|---|
| ***C10L 10/00*** | (2006.01) |
| ***C10B 43/04*** | (2006.01) |
| ***C10B 43/10*** | (2006.01) |

(52) U.S. Cl.

CPC ..... *C10B 43/04* (2013.01); *C10B 43/10* (2013.01)

(58) Field of Classification Search

CPC ..... C10B 37/02; C10B 43/02; C10B 33/08; C10B 33/02

(Continued)

(56) References Cited

U.S. PATENT DOCUMENTS

| | | | |
|---|---|---|---|
| 425,797 | A | 4/1890 | Hunt |
| 469,868 | A | 3/1892 | Thomas et al. |

(Continued)

FOREIGN PATENT DOCUMENTS

| | | |
|---|---|---|
| CA | 1172895 | 8/1984 |
| CA | 2775992 | 5/2011 |

(Continued)

OTHER PUBLICATIONS

Crelling, et al., "Effects of Weathered Coal on Coking Properties and Coke Quality", Fuel, 1979, vol. 58, Issue 7, pp. 542-546.

(Continued)

*Primary Examiner* — Vivek Shirsat

(74) *Attorney, Agent, or Firm* — Perkins Coie LLP

(57) ABSTRACT

The present technology is generally directed to methods of decarbonizing coking ovens, and associated systems and devices. In some embodiments, a method of operating and decarbonizing a coking oven can include inserting a charge of coal into the coking oven and heating the coal. The method can further include removing at least a portion of the charge, leaving behind coking deposits in the coking oven. At least a portion of the deposits can be continuously removed from the coking oven. For example, in some embodiments, at least a portion of the deposits can be removed each time a new charge of coal is inserted in the coking oven.

27 Claims, 13 Drawing Sheets

(58) Field of Classification Search
USPC ..... 431/3; 202/241, 262
See application file for complete search history.

(56) References Cited

U.S. PATENT DOCUMENTS 845,719 A 2/1907 Schniewind
976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Klaiber
1,677,973 A 7/1928 Marquard
1,705,039 A 3/1929 Thornhill
1,721,813 A 7/1929 Rudolf et al.
1,757,682 A 5/1930 Palm
1,818,370 A 8/1931 Wine
1,818,994 A 8/1931 Kreisinger
1,830,951 A * 11/1931 Lovett ..... C10B 33/02 414/214
1,848,818 A 3/1932 Becker
1,947,499 A 2/1934 Schrader et al.
1,955,962 A 4/1934 Jones
2,075,337 A 3/1937 Burnaugh
2,141,035 A 12/1938 Daniels
2,394,173 A 2/1946 Harris et al.
2,424,012 A 7/1947 Bangham et al.
2,649,978 A 8/1953 Such
2,667,185 A 1/1954 Beavers
2,723,725 A 11/1955 Keiffer
2,756,842 A 7/1956 Chamberlin et al.
2,813,708 A 11/1957 Frey
2,827,424 A * 3/1958 Homan ..... C10B 39/04 202/227
2,873,816 A 2/1959 Emil et al.
2,902,991 A 9/1959 Whitman
3,015,893 A 1/1962 McCreary
3,033,764 A 5/1962 Hannes
3,224,805 A 12/1965 Clyatt
3,462,345 A 8/1969 Kernan
3,511,030 A 5/1970 Brown et al.
3,542,650 A 11/1970 Kulakov
3,545,470 A 12/1970 Paton
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobie et al.
3,844,900 A 10/1974 Schulte
3,857,758 A 12/1974 Mole
3,875,016 A 4/1975 Schmidt-Balve et al.
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach et al.
3,975,148 A 8/1976 Fukuda et al.
3,984,289 A 10/1976 Sustarsic et al.
4,004,702 A 1/1977 Szendroi
4,004,983 A 1/1977 Pries
4,025,395 A 5/1977 Ekholm et al.
4,040,910 A 8/1977 Knappstein et al.
4,045,299 A 8/1977 MacDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,111,757 A 9/1978 Carimboli
4,124,450 A 11/1978 MacDonald
4,135,948 A * 1/1979 Mertens ..... C10B 43/04 134/6
4,141,796 A 2/1979 Clark et al.
4,145,195 A 3/1979 Knappstein et al.
4,147,230 A 4/1979 Ormond et al.
4,162,546 A 7/1979 Shortell et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,289,585 A 4/1981 Porter
4,271,814 A 6/1981 Lister
4,263,099 A 8/1981 Porter
4,284,478 A 8/1981 Brommel
4,285,772 A 8/1981 Kress
4,287,024 A 9/1981 Thompson
4,289,584 A 9/1981 Chuss et al.
4,296,938 A 10/1981 Offermann et al.
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,394,217 A * 7/1983 Holz ..... C10B 33/06 202/227
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett

(56) References Cited

U.S. PATENT DOCUMENTS 4,487,137 A 12/1984 Horvat et al.
4,498,786 A 2/1985 Ruscheweyh
4,506,025 A 3/1985 Kleeb et al.
4,508,539 A 4/1985 Nakai
4,527,488 A 7/1985 Lindgren
4,564,420 A 1/1986 Spindeler et al.
4,568,426 A 2/1986 Orlando et al.
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando et al.
4,704,195 A 11/1987 Janicka et al.
4,720,262 A 1/1988 Durr et al.
4,726,465 A 2/1988 Kwasnik et al.
4,793,931 A 12/1988 Doyle et al.
4,824,614 A 4/1989 Jones et al.
4,889,698 A 12/1989 Moller et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,423,152 A 6/1995 Kolvek
5,447,606 A 9/1995 Prutt et al.
5,480,594 A 1/1996 Wilkerson et al.
5,542,650 A * 8/1996 Abel ..... F27D 3/1527 15/246
5,622,280 A 4/1997 Mays et al.
5,659,110 A 8/1997 Herden et al.
5,670,025 A 9/1997 Baird
5,687,768 A 11/1997 Albrecht et al.
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,412,221 B1 7/2002 Emsbo
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 9/2006 Lee
7,314,060 B2 1/2008 Chen et al.
7,331,298 B2 2/2008 Taylor et al.
7,433,743 B2 10/2008 Pistikopoulos et al.
7,497,930 B2 3/2009 Barkdoll et al.
7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll et al.
8,071,060 B2 12/2011 Ukai et al.
8,079,751 B2 12/2011 Kapila et al.
8,080,088 B1 12/2011 Srinivasachar
8,152,970 B2 4/2012 Barkdoll et al.
8,236,142 B2 8/2012 Westbrook et al.
8,266,853 B2 9/2012 Bloom et al.
8,398,935 B2 3/2013 Howell, Jr. et al.
8,409,405 B2 4/2013 Kim et al.
8,647,476 B2 2/2014 Kim et al.
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,193,915 B2 11/2015 West et al.
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2005/0087767 A1 4/2005 Fitzgerald et al.
2006/0102420 A1 5/2006 Huber et al.
2006/0149407 A1 7/2006 Markham et al.
2007/0116619 A1 5/2007 Taylor et al.
2007/0251198 A1 11/2007 Witter
2008/0028935 A1 2/2008 Andersson
2008/0169578 A1 7/2008 Crane et al.
2008/0179165 A1 7/2008 Chen et al.
2008/0257236 A1 10/2008 Green
2008/0271985 A1 11/2008 Yamasaki
2008/0289305 A1 11/2008 Girondi
2009/0007785 A1 1/2009 Kimura et al.
2009/0152092 A1 6/2009 Kim et al.
2009/0162269 A1 6/2009 Barger et al.
2009/0217576 A1 9/2009 Kim et al.
2009/0283395 A1 11/2009 Hippe
2010/0095521 A1 4/2010 Kartal et al.
2010/0113266 A1 5/2010 Abe et al.
2010/0115912 A1 5/2010 Worley et al.
2010/0181297 A1 7/2010 Whysail
2010/0196597 A1 8/2010 Di Loreto
2010/0276269 A1 11/2010 Schuecker et al.
2010/0287871 A1 11/2010 Bloom et al.
2010/0300867 A1 12/2010 Kim et al.
2010/0314234 A1 12/2010 Knoch et al.
2011/0048917 A1 3/2011 Kim et al.
2011/0088600 A1 4/2011 McRae
2011/0120852 A1 5/2011 Kim et al.
2011/0144406 A1 6/2011 Masatsugu et al.
2011/0168482 A1 7/2011 Merchant et al.
2011/0174301 A1 7/2011 Haydock et al.
2011/0192395 A1 8/2011 Kim et al.
2011/0198206 A1 8/2011 Kim et al.
2011/0223088 A1 9/2011 Chang et al.
2011/0253521 A1 10/2011 Kim
2011/0291827 A1 12/2011 Baldocchi et al.
2011/0313218 A1 12/2011 Dana
2011/0315538 A1 12/2011 Kim et al.
2012/0024688 A1 2/2012 Barkdoll
2012/0030998 A1 2/2012 Barkdoll et al.
2012/0152720 A1 6/2012 Reichelt et al.
2012/0180133 A1 7/2012 Al-Harbi et al.
2012/0228115 A1 9/2012 Westbrook
2012/0247939 A1 10/2012 Kim et al.
2012/0305380 A1 12/2012 Wang et al.
2013/0020781 A1 1/2013 Kishikawa
2013/0045149 A1 2/2013 Miller
2013/0216717 A1 8/2013 Rago et al.
2013/0220373 A1 8/2013 Kim
2013/0306462 A1 11/2013 Kim et al.
2014/0033917 A1 2/2014 Rodgers et al.
2014/0039833 A1 2/2014 Sharpe, Jr. et al.
2014/0048402 A1 2/2014 Quanci et al.
2014/0048404 A1 2/2014 Quanci et al.
2014/0048405 A1 2/2014 Quanci et al.

(56) References Cited

U.S. PATENT DOCUMENTS

| | | | |
|---|---|---|---|
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0183026 | A1 | 7/2014 | Quanci et al. |
| 2014/0208997 | A1 | 7/2014 | Alferyev et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0219530 | A1 | 8/2015 | Li et al. |
| 2015/0287026 | A1 | 10/2015 | Yang et al. |
| 2016/0026193 | A1 | 1/2016 | Rhodes et al. |
| 2016/0048139 | A1 | 2/2016 | Samples et al. |
| 2016/0149944 | A1 | 5/2016 | Obermeier et al. |
| 2017/0015908 | A1 | 1/2017 | Quanci et al. |
| 2019/0161682 | A1 | 5/2019 | Quanci et al. |
| 2019/0169503 | A1 | 6/2019 | Chun et al. |

FOREIGN PATENT DOCUMENTS

| | | | |
|---|---|---|---|
| CA | 2822841 | | 7/2012 |
| CA | 2822857 | A1 | 7/2012 |
| CN | 87212113 | U | 6/1988 |
| CN | 87107195 | A | 7/1988 |
| CN | 2064363 | | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 201121178 | Y | 9/2008 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |
| CN | 102155300 | A | 8/2011 |
| CN | 2509188 | Y | 11/2011 |
| CN | 202226816 | U | 5/2012 |
| CN | 202265541 | U | 6/2012 |
| CN | 102584294 | A | 7/2012 |
| CN | 202415446 | U | 9/2012 |
| CN | 103468289 | A | 12/2013 |
| CN | 105189704 | A | 12/2015 |
| CN | 106661456 | A | 5/2017 |
| DE | 201729 | C | 9/1908 |
| DE | 212176 | | 7/1909 |
| DE | 1212037 | B | 3/1966 |
| DE | 3315738 | A1 | 11/1983 |
| DE | 3231697 | C1 | 1/1984 |
| DE | 3329367 | C | 11/1984 |
| DE | 3328702 | A1 | 2/1985 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102005015301 | | 10/2006 |
| DE | 102006004669 | | 8/2007 |
| DE | 102006026521 | A1 | 12/2007 |
| DE | 102009031436 | A1 | 1/2011 |
| DE | 102011052785 | B3 | 12/2012 |
| EP | 0126399 | A1 | 11/1984 |
| EP | 0208490 | | 1/1987 |
| EP | 0903393 | A2 | 3/1999 |
| EP | 2295129 | | 3/2011 |
| FR | 2339664 | | 8/1977 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | A | 6/1961 |
| GB | 923205 | A | 5/1963 |
| JP | H11-131074 | | 5/1919 |
| JP | 50148405 | A | 11/1975 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | A | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | 06264062 | | 9/1994 |
| JP | 07188668 | | 7/1995 |
| JP | 07216357 | | 8/1995 |
| JP | H08104875 | A | 4/1996 |
| JP | 08127778 | | 5/1996 |
| JP | H10273672 | A | 10/1998 |
| JP | 2000204373 | A | 7/2000 |
| JP | 2001200258 | A | 7/2001 |
| JP | 2002106941 | | 4/2002 |
| JP | 200341258 | A | 2/2003 |
| JP | 2003071313 | | 3/2003 |
| JP | 2003292968 | A | 10/2003 |
| JP | 2003342581 | A | 12/2003 |
| JP | 2005263983 | A | 9/2005 |
| JP | 2006188608 | A | 7/2006 |
| JP | 2007063420 | A | 3/2007 |
| JP | 2008231278 | A | 10/2008 |
| JP | 2009144121 | A | 7/2009 |
| JP | 2010248389 | A | 11/2010 |
| JP | 2012102302 | | 5/2012 |
| JP | 2013006957 | A | 1/2013 |
| JP | 2014040502 | A | 3/2014 |
| KR | 960008754 | Y1 | 10/1996 |
| KR | 1019990054426 | | 7/1999 |
| KR | 20000042375 | A | 7/2000 |
| KR | 1020050053861 | A | 6/2005 |
| KR | 100737393 | B1 | 7/2007 |
| KR | 100797852 | | 1/2008 |
| KR | 1020110010452 | A | 2/2011 |
| KR | 101314288 | | 4/2011 |
| KR | 100296700 | B1 | 10/2011 |
| KR | 20130050807 | | 5/2013 |
| KR | 101318388 | B1 | 10/2013 |
| RU | 2441898 | C2 | 2/2012 |
| SU | 1535880 | A1 | 1/1990 |
| TW | 201241166 | A | 10/2012 |
| UA | 50580 | | 10/2002 |
| WO | WO9012074 | | 10/1990 |
| WO | WO9945083 | | 9/1999 |
| WO | WO2005023649 | | 3/2005 |
| WO | WO2005115583 | | 12/2005 |
| WO | WO2007103649 | | 9/2007 |
| WO | WO2008034424 | | 3/2008 |

(56) References Cited

FOREIGN PATENT DOCUMENTS

| | | | |
|---|---|---|---|
| WO | 2011000447 | A1 | 1/2011 |
| WO | WO2012029979 | | 3/2012 |
| WO | WO2012031726 | | 3/2012 |
| WO | 2013023872 | A1 | 2/2013 |
| WO | WO2010107513 | | 9/2013 |
| WO | WO2014021909 | | 2/2014 |
| WO | WO2014105064 | | 7/2014 |
| WO | WO2014153050 | | 9/2014 |
| WO | WO2016004106 | | 1/2016 |

OTHER PUBLICATIONS

Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
JP 03-197588, Inoqu Keizo et al., Method and Equipment for Boring Degassing Hole in Coal Charge in Coke Oven, Japanese Patent (Abstract Only) Aug. 28, 1991.
JP 04-159392, Inoue Keizo et al., Method and Equipment for Opening Hole for Degassing of Coal Charge in Coke Oven, Japanese Patent (Abstract Only) Jun. 2, 1992.
U.S. Appl. No. 14/655,003, filed Jun. 23, 2015, Ball, Mark A., et al.
U.S. Appl. No. 14/655,013, filed Jun. 23, 2015, West, Gary D., et al.
U.S. Appl. No. 14/655,204, filed Jun. 24, 2015, Quanci, John F., et al.
U.S. Appl. No. 14/839,384, filed Aug. 28, 2015, Quanci, John F., et al.
U.S. Appl. No. 14/839,493, filed Aug. 28, 2015, Quanci, John F., et al.
U.S. Appl. No. 14/839,551, filed Aug. 28, 2015, Quanci, John F., et al.
U.S. Appl. No. 14/839,588, filed Aug. 28, 2015, Quanci, John F., et al.
U.S. Appl. No. 14/865,581, filed Sep. 25, 2015, Sarpen, Jacob P., et al.
International Search Report and Written Opinion issued in PCT/US2014/073034, dated Apr. 20, 2015, 18 pages.
U.S. Appl. No. 14/952,267, filed Nov. 25, 2015, Quanci et al.
U.S. Appl. No. 14/959,450, filed Dec. 4, 2015, Quanci et al.
U.S. Appl. No. 14/983,837, filed Dec. 30, 2015, Quanci et al.
U.S. Appl. No. 14/984,489, filed Dec. 30, 2015, Quanci et al.
U.S. Appl. No. 14/986,281, filed Dec. 31, 2015, Quanci et al.
U.S. Appl. No. 14/987,625, filed Jan. 4, 2016, Quanci et al.
U.S. Appl. No. 15/014,547, filed Feb. 3, 2016, Choi et al.
Basset, et al., "Calculation of steady flow pressure loss coefficients for pipe junctions," Proc Instn Mech Engrs., vol. 215, Part C. IMechIE 2001.
Costa, et al., "Edge Effects on the Flow Characteristics in a 90 deg Tee Junction," Transactions of the ASME, Nov. 2006, vol. 128, pp. 1204-1217.
U.S. Appl. No. 07/587,742, filed Sep. 25, 1990, now U.S. Pat. No. 5,114,542, titled Nonreceovery Coke Oven Battery and Method of Operation.
U.S. Appl. No. 07/878,904, filed May 6, 1992, now U.S. Pat. No. 5,318,671, titled Method of Operation of Nonreceovery Coke Oven Battery.
U.S. Appl. No. 08/914,140, filed Aug. 19, 1997, now U.S. Pat. No. 5,928,478, titled Nonrecovery Coke Oven Door.
U.S. Appl. No. 12/405,269, filed Mar. 17, 2009, now U.S. Pat. No. 7,998,316, titled Flat Push Coke Wet Quenching Appratus and Process.
U.S. Appl. No. 13/205,960, field Aug. 9, 2011, now U.S. Pat. No. 9,321,965, titled Flat Push Coke Wet Quenching Apparatus and Process.
U.S. Appl. No. 12/849,192, filed Aug. 3, 2010, now U.S. Pat. No. 9,200,225, titled Method and Appratus for Compacting Coal for a Coal Coking Process.
U.S. Appl. No. 13/631,215, filed Sep. 28, 2012, titled Methods for Handling Coal Processing Emissions and Associated Systems and Devices.
U.S. Appl. No. 13/843,166, now U.S. Pat. No. 9,273,250, filed Mar. 15, 2013, titled Methods and Systems for Improved Quenched Tower Design.
U.S. Appl. No. 14/865,581, filed Sep. 25, 2015, titled Method and Appratus for Testing Coal Coking Properties.
U.S. Appl. No. 14/839,588, filed Aug. 28, 2015, titled Method and System for Optimizing Coke Plant Operation and Output.
U.S. Appl. No. 14/983,837, filed Dec. 30, 2015, titled Multi-Modal Beds fof Coking Material.
U.S. Appl. No. 14/986,281, filed Dec. 31, 2015, titled Multi-Modal Beds fof Coking Material.
U.S. Appl. No. 14/839,493, filed Aug. 28, 2015, titled Method and System for Optimiziing Coke Plant Operation and Output.
U.S. Appl. No. 07/878,904, filed May 6, 1992, now U.S. Pat. No. 5,318,671, title Method of Operation of Nonrecovery Coke Oven Battery.
U.S. Appl. No. 07/783,195, field Feb. 14, 2001, now U.S. Pat. No. 6,596,128, titled Coke Oven Flue Gas Sharing.
U.S. Appl. No. 08/059,673, filed May 12, 1993, now U.S. Pat. No. 5,447,606, titled Method of and Appraratus for Capturing Coke Oven Charging Emissions.
U.S. Appl. No. 08/914,140, field Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Appratus for Coal Coking.
U.S. Appl. No. 11/424,566, filed Jun. 16, 2006, now U.S. Pat. No. 7,497,930, titled Method and Appratus for Compacting Coal for a Coal Coking Process.
U.S. Appl. No. 13/843,166, now U.S. Pat. No. 9,273,250, filed Mar. 5, 2013, titled Methods and Systems for Improved Quench Tower Design.
U.S. Appl. No. 14/839,493, filed Aug. 28, 2015, titled Method and System for Optimizing Coke Plant Operating and Output.
U.S. Appl. No. 15/322,176, filed Dec. 27, 2016, West et al.
U.S. Appl. No. 15/443,246, filed Feb. 27, 2017, Quanci et al.
U.S. Appl. No. 15/511,038, filed Mar. 14, 2014, West et al.
Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
U.S. Appl. No. 07/587,742, filed Sep. 25, 1990, now U.S. Pat. No. 5,114,542, titled Nonrecovery Coke Overn Battery and Method of Operation.
U.S. Appl. No. 09/680,187, filed Oct. 5, 2000, now U.S. Pat. No. 6,290,494, titled Method aned Apparatus for Coal Coking.
U.S. Appl. No. 15/014,547, filed Feb. 3, 2016, titled Methods and Systems for Improved Quenched Tower Design.
U.S. Appl. No. 13/588,996, now U.S. Pat. No. 9,243,186, filed on Aug. 17, 2012, titled Coke Plant Including Exhaust Gas Sharing.
U.S. Appl. No. 15/281,891, filed Sep. 30, 2016, titled Exhaust Flow Modifier, Duck Internsection Incorporating the Same, and Methods Therefor.
U.S. Appl. No. 15/322,176, filed Dec. 27, 2016, titled Horizontal Heat Recovery Coke Ovens Habing Monolith Crowns.
U.S. Appl. No. 15/511,036, filed Mar. 14, 2017, Coke Ovens Having Monolith Component Construction.
U.S. Appl. No. 13/589,009, filed Aug. 17, 2012, titled Automatic Draft Contron System for Coke Plants.
U.S. Appl. No. 15/614,625, filed Jun. 5, 2017, titled Methods and Systems for Automatically Generating a Remedial Action in an Industrial Facility.
U.S. Appl. No. 07/878,904, filed May 6, 1992, now U.S. Pat. No. 5,318,671, titled Method of Operation of Nonrecoverry Coke Oven Battery.

(56) References Cited

OTHER PUBLICATIONS

U.S. Appl. No. 14/655,204, filed Jun. 24, 2015, titled Systems and Metods for Removing Mercury From Emissions.
U.S. Appl. No. 14/655,003, filed Jun. 23, 2015, titled System and Methods for Maintaining a Hot Car in a Coke Plant.
U.S. Appl. No. 13/829,588, now U.S. Pat. No. 9,139,915, filed Mar. 14, 2013, titled Horizontal Heat Recovery Coke Ovens Having Monolith Crowns.
U.S. Appl. No. 14/987,625, filed Jan. 4, 2016, titled Integrated Coke Plant Automation and Optimization Using Advanced Control and Optimization Techhniques.
ASTM D5341-99(2010)e1, Standard Test Method for Measuring Coke Reactivity Index (CRI) and Coke Strength After Reaction (CSR), ASTM International, West Conshohocken, PA, 2010.
Clean coke process: process development studies by USS Engineers and Consultants, Inc., Wisconsin Tech Search, request date Oct. 5, 2011, 17 pages.
Rose, Harold J., "The Selection of Coals for the Manufacture of Coke," American Institute of Mining and Metallurgical Engineers, Feb. 1926, 8 pages.
U.S. Appl. No. 15/139,568, filed Apr. 27, 2016, Quanci et al.
Waddell, et al., "Heat-Recovery Cokemaking Presentation," Jan. 1999, pp. 1-25.
Westbrook, "Heat-Recovery Cokemaking at Sun Coke," AISE Steel Technology, Pittsburg, PA, vol. 76, No. 1, Jan. 1999, pp. 25-28.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
U.S. Appl. No. 15/392,942, filed Dec. 28, 2016, Quanci et al.
U.S. Appl. No. 07/587,742, filed Sep. 25, 1990, now U.S. Pat. No. 5,14,542, titled Nonrecovery Coke Oven Battery and Method of Operation.
U.S. Appl. No. 07/886,804, filed May 22, 1992, now U.S. Pat. No. 5,228,955, titled High Strength Coke Oven Wall Habing Gas Flues Therein.
U.S. Appl. No. 09/914,140, filed Aug. 19, 1997, now U.S. Pat. No. 5,928,476, titled Nonrecovery Coke Oven Door.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 10, 2006, now U.S. Pat. No. 7,497,930, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/830,971, filed Mar. 14, 2013, titled Non-Perpendicular Connections Between Coke Oven Uptakes and a Hot Common Tunnel, and Associated Systems and Methods.
U.S. Appl. No. 13/730,598, filed Dec. 28, 2012, now U.S. Pat. No. 9,238,778, titled Systems and Methods for Improving Quenched Coke Recovey.
U.S. Appl. No. 14/952,267, filed Nov. 25, 2015, titled Systems and Methods for Improving Quenched Coke Recovery.
U.S. Appl. No. 15/014,547, filed Dec. 3, 2016, titled Methods and Systems for Improved Quench Tower Design.
U.S. Appl. No. 15/511,036, filed Mar. 14, 2017, titled Coke Ovens Having Monolith Component Construction.
U.S. Appl. No. 14/959,450, filed Dec. 4, 2015, titled Coke Plant Including Exhaust Gas Sharing.
U.S. Appl. No. 15/281,891, filed Sep. 30, 2016, titled Exhaust Flow Modifier, Duck Intersection Incorporating the Same, and Methods Therefor.
U.S. Appl. No. 14/865,581, filed Sep. 25, 2015, titled Method and Apparatus for Testing Coal Coking Properties.
U.S. Appl. No. 15/443,246, filed Feb. 27, 2017, titled Coke Oven Charging System.
U.S. Appl. No. 14/839,493, filed Aug. 28, 2015, titled Method and System for Optimizing Coke Plant Operation and Output.
U.S. Appl. No. 14/839,551, filed Aug. 28, 2015, titled Burn Profiles for Coke Operations.
U.S. Appl. No. 15/392,942, filed Dec. 28, 2016, titled Method and System for Dynamicallly Charging a Coke Oven.
U.S. Appl. No. 15/614,525, filed Jun. 5, 2017, titled Methods and Systems for Automatically Generating a Remedial Action in an Industral Facility.
U.S. Appl. No. 15/987,860, filed May 23, 2018, Crum et al.
U.S. Appl. No. 16/000,516, filed Jun. 5, 2018, Quanci.
Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.
Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
U.S. Appl. No. 13/730,598, filed Dec. 28, 2012, now U.S. Pat. No. 9,238,778, titled Systems and Methods for Improving Quenched Coke Recovery.
U.S. Appl. No. 15/014,547, field Feb. 3, 2016, titled Methods and Systems for Improved Quench Tower Design.
U.S. Appl. No. 13/730,673, filed Dec. 28, 2012, titled titled Exhaust Flow Modifier Duct Intersection Incorporating the Same, and Methods Therefor.
U.S. Appl. No. 15/281,891, filed Sep. 30, 2016, titled Exhaust Flow Modifier Duct Intersection Incorporating the same, and Methods Therefor.
Bloom, et al., "Modular cast block—The future of coke oven repairs," Iron & Steel Technol, AIST, Warrendale, PA, vol. 4, No. 3, Mar. 1, 2007, pp. 61-64.
Examination Report for European Application No. 14877178.5; dated Dec. 12, 2017; 5 pages.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, tiled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable In Situ Spark Arrestor.

(56) References Cited

OTHER PUBLICATIONS

U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/63,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/921,723, filed Oct. 23, 2015, titled Reduced Output Rate Coke Oven Operation With Gas Sharing Providing Extended Process Cycle.
U.S. Appl. No. 14/655,204, filed Jun. 24, 2015, titled Systems and Methods for Removing Mercury From Emissions.
U.S. Appl. No. 16/000,516, filed Jun. 5, 2018, titled Systems and Methods for Removing Mercury From Emissions.
U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.
U.S. Appl. No. 16/026,363, filed Jul. 3, 2018, titled Non-Perpendicular Connections Between Coke Oven Uptakes and a Hot Common Tunnel, and Associated Systems and Methods.
U.S. Appl. No. 13/730,796, filed Dec. 28, 2012, titled Methods and Systems for Improved Coke Quenching.
U.S. Appl. No. 13/730,598, filed Dec. 28, 2012, now U.S. Pat. No. 9,238,778, titled Systems and Methds for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 15/014,547, filed Feb. 3, 2016, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/322,176, filed Dec. 27, 2016, titled Horizontal Heat Recovery Coke Ovens Having Monolith Crowns.
U.S. Appl. No. 15/511,036, filed Mar. 14, 2017, titled Coke Ovens Having Monolith Components Construction.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.
U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing, now U.S. Pat. No. 10,041,002.
U.S. Appl. No. 16/047,198, filed Jul. 27, 2018, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, titled Exhaust Flow Modifier, Duct Intersection Incorporating the Same, Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, titled Coke Oven Charging System.
U.S. Appl. No. 15/443,246, now U.S. Pat. No. 9,976,089, filed Feb. 27, 2017, titled Coke Oven Charging System.
U.S. Appl. No. 14/984,489, filed Dec. 30, 2015, titled Multi-Modal Beds of Coking Material.
U.S. Appl. No. 14/983,837, filed Dec. 30, 2015, titled Multi-Modal Beds of Coking Material.
U.S. Appl. No. 14/986,281, filed Dec. 31, 2015, titled Multi-Modal Beds of Coking Material.
U.S. Appl. No. 14/987,625, filed Jan. 4, 2016, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, titled System and Method for Repairing a Coke Oven.
U.S. Appl. No. 16/251,352, filed Jan. 18, 2019, Quanci et al.
U.S. Appl. No. 16/428,014, filed May 31, 2019, Quanci et al.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Industrial Furnace Design Handbook, Editor-in-Chief: First Design Institute of First Ministry of Machinery Industry, Beijing: Mechanical Industry Press, pp. 180-183, Oct. 1981.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
Chinese Office Action in Chinese Application No. 201480073538.3; dated Oct. 8, 2018; 25 pages.
India First Examination Report in Application No. 201637026058; dated Apr. 26, 2019; 8 pages.
U.S. Appl. No. 15/614,525, filed Jun. 5, 2017, Quanci et al.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http://web.archive.

(56) References Cited

OTHER PUBLICATIONS org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11.

Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.

* cited by examiner

METHODS FOR DECARBONIZING COKING OVENS, AND ASSOCIATED SYSTEMS AND DEVICES

CROSS-REFERENCE TO RELATED APPLICATIONS

This application claims the benefit of U.S. Provisional Patent Application No. 61/922,614, filed Dec. 31, 2013, the disclosure of which is incorporated herein by reference in its entirety.

TECHNICAL FIELD

The present technology is generally directed to methods of decarbonizing coking ovens, and associated systems and devices.

BACKGROUND

Coke is a solid carbon fuel and carbon source used to melt and reduce iron ore in the production of steel. To make coke, finely crushed coal is fed into a coke oven and heated in an oxygen depleted environment under closely controlled atmospheric conditions. Such an environment drives off volatile compounds in the coal, leaving behind coke. In some coking plants, once the coal is "coked out" or fully coked, an oven door is opened and the hot coke is pushed from the oven into a hot box of a flat push hot car ("hot car"). The hot car then transports the hot coke from the coke oven to a quenching area (e.g., wet or dry quenching) to cool the coke below its ignition temperature. After being quenched, the coke is screened and loaded into rail cars or trucks for shipment or later use.

Over time, the volatile coal constituents (i.e., water, coal-gas, coal-tar, etc.) released during the coking process can accumulate on the interior surfaces of the coke oven, forming gummy, solidified coking deposits. As used herein, "coking deposit(s)" refers to one or more residual materials that can accumulate within the coke oven, such as, for example, clinkers, ash, and others. Such deposits can have a variety of adverse effects on coke production, including slowing and/or complicating the hot coke pushing operation, decreasing the effective dimensions of the oven, and lowering the thermal conductivity of the oven walls and/or floor. Because of such adverse effects, deposit removal ("decarbonization") is a mandatory aspect of routine coke oven maintenance in order to maintain coke plant efficiency and yield.

To remove deposits from the coke ovens, oven operation (and, thus, coke production) must be interrupted so that the deposits can be targeted and pushed out of the ovens and into the hot car for disposal. Traditionally, an oven is pulled out of service once every 1-3 years for decarbonization. During those 1-3 years, the deposits have become a near indestructible solid piece of slag that is bound to various interior surfaces of the coke oven, including the floor, sidewalls, and the crown. Much like the hot coke, deposits are extremely hot and exert a large amount of thermal and mechanical stress on the coking machinery. Many conventional coke plants attempt to mitigate damage to the machinery by breaking up large deposits and transporting them to a quench tower for cooling in manageable, smaller portions. However, such an iterative approach takes a long time to remove the waste, thus keeping the ovens/quench tower out of operation and coke production at a halt. In addition, removing the waste in pieces increases the number of transports required of the hot cars, exposing hot cars and/or its individual components to increased amount of thermal and mechanical stress.

DETAILED DESCRIPTION

The present technology is generally directed to methods of decarbonizing coking ovens, and associated systems and devices. In some embodiments, a method of operating and decarbonizing a coking oven can include inserting a charge of loose coal into the coking oven and heating the coal. The method can further include removing at least a portion of the charge, leaving behind coking deposits in the coking oven. At least a portion of the deposits can be continuously removed from the coking oven. For example, in some embodiments, at least a portion of the deposits can be removed each time a new charge of coal is inserted in the coking oven.

Specific details of several embodiments of the technology are described below with reference to FIGS. 1A-14. Other details describing well-known structures and systems often associated with coke ovens and decarbonizing have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1A-14.

Figure 1A:
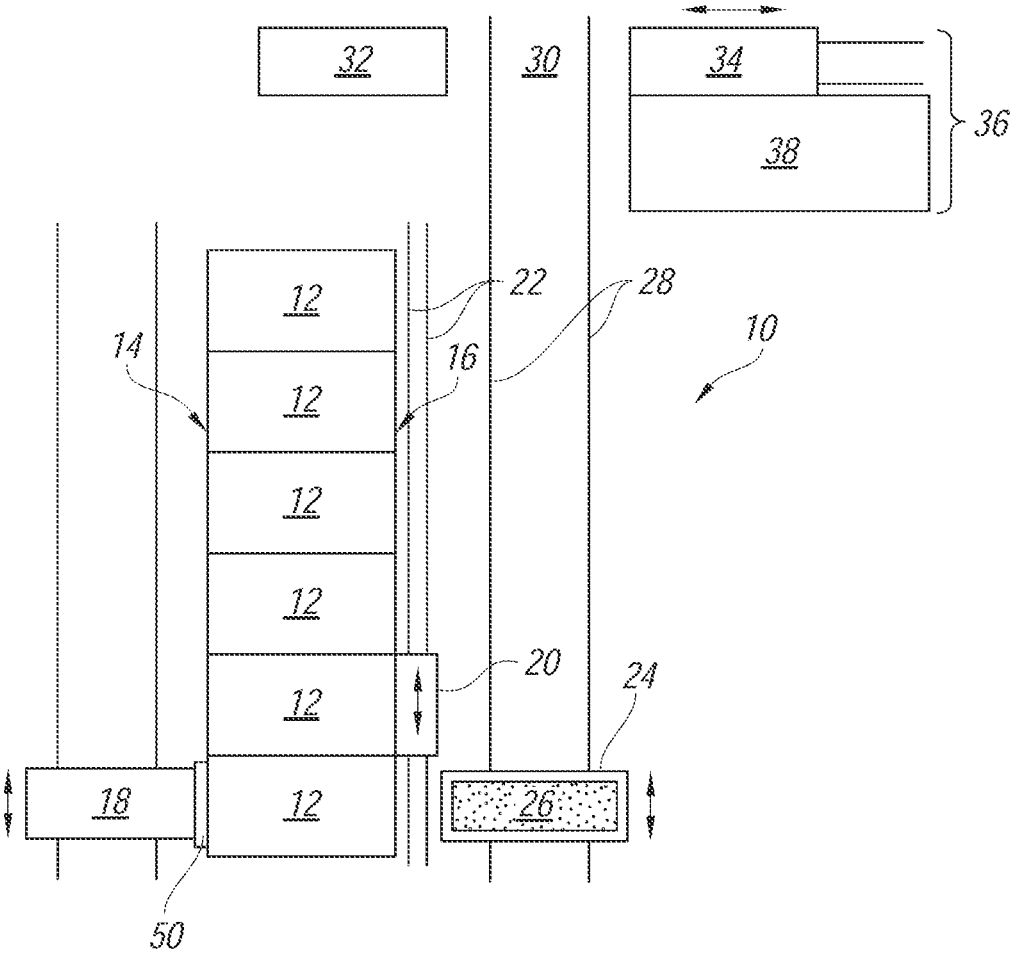
FIG. 1A is a plan schematic view of a portion of a coke plant configured in accordance with embodiments of the present technology.
Figure 1B:
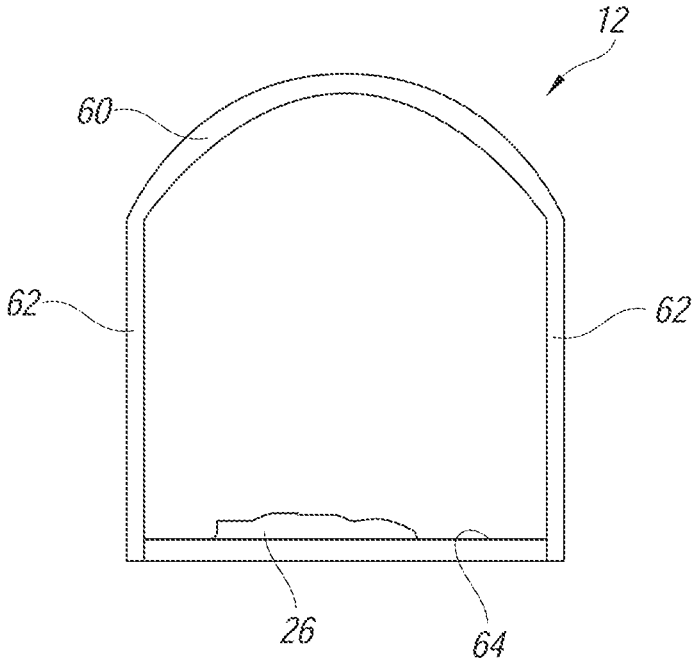
FIG. 1B is a partially schematic front view of a coke oven having coke deposits therein and configured in accordance with embodiments of the present technology.

FIG. 1A is a plan schematic view of a coke oven battery 10 configured in accordance with embodiments of the technology. FIG. 1B is a front view of an individual coke oven 12 having coke deposits 26 therein and configured in accordance with embodiments of the present technology. Referring to FIGS. 1A and 1B together, the typical coke oven battery 10 contains a plurality of side-by-side coke ovens 12. Each of the coke ovens 12 can have a coal inlet end 14 and a coke outlet end 16 opposite the inlet end 14. Each individual coke oven 12 further includes an oven floor 64, a plurality of sidewalls 62, and an oven crown 60 coupled to the sidewalls 62 and atop a coking chamber.

The oven can receive coal, such as loose, non-stamp-charged coal, from the inlet end 14. The coal can be heated in the coke oven 12 until it is fully coked (typically 24-120 hours). An exit door removing device 20 can be positioned adjacent the outlet end 16 of the coke oven 12 and can remove an exit door of the coke oven 12. After removing the exit door, the door removing device 20 can be moved away from the outlet end 16 of the coke oven 12 along door removal rails 22. A retractable discharge (or "pushing") ram 18 positioned adjacent to the inlet end 14 of the coke oven 12 pushes the hot coke and/or deposits out of the coke oven 12. In several embodiments, the discharge ram 18 can include a ram head supported and driven by a ram arm. In some embodiments, all or part of the discharge ram 18 is adjustable via a hydraulic system capable of vertical movement. In some embodiments, the discharge ram 18 may include a device for removing an inlet end 14 oven door prior to pushing the coke/deposits out of the coke oven 12. As will be described in further detail below, the discharge ram 18 can include or be coupled to a decarbonization system 50 configured to remove the coke deposits 26 from the coke oven 12. In further embodiments, the decarbonization system 50 and coke-charging aspects of the system can each use separate, dedicated retractable rams.

In some embodiments, the decarbonization system 50 can provide high-pressure removal of the coke deposits 26 from the coke oven 12. For example, in some embodiments, as will be discussed in more detail below, the decarbonization system 50 can include various scoring and/or scraping features to break up the compacted deposits and/or remove the deposits from the oven. In some embodiments, the deposits 26 can be broken up and/or removed continuously. As used herein, the term "continuously" is used to indicate a routine breaking or removal of the deposits that occurs on a schedule more frequently than traditional annual oven cleaning. For example, continuous removal can indicate that the deposits 26 are removed from the coke oven 12 at least monthly, weekly, daily, or each time a new charge of coal is inserted in the coke oven 12, such as before, during, or after the charge is inserted or removed.

A hot car 24 can be positioned adjacent to the outlet end 16 of the coke oven 12 for collection of hot coke and/or deposits 26 pushed from the oven by the discharge ram 18. The "hot car" may comprise a flat push hot car, train, and/or a combined flat push hot car/quench car. Once the hot coke or deposits 26 are loaded onto the hot car 24, the car 24 can be transported on rails 28 to a quench car area 30. In the quench car area 30, the hot coke slab or deposits 26 on the hot car 24 can be pushed by a stationary pusher 32 onto a quench car 34. Once the quench car 34 receives the hot coke or deposits 26, the quench car 34 can be positioned in a quench station 36 wherein the hot coke or deposits 26 can be quenched with sufficient water to cool the coke or deposits 26 to below a coking temperature. Various embodiments may use a combined hot car/quench car that allows the hot coke or deposits 26 to be transported directly from the coke oven 12 to the quench station 36 using a single hot car. The quenched coke can then be dumped onto a receiving dock 38 for further cooling and transport to a coke storage area.

Figure 2:
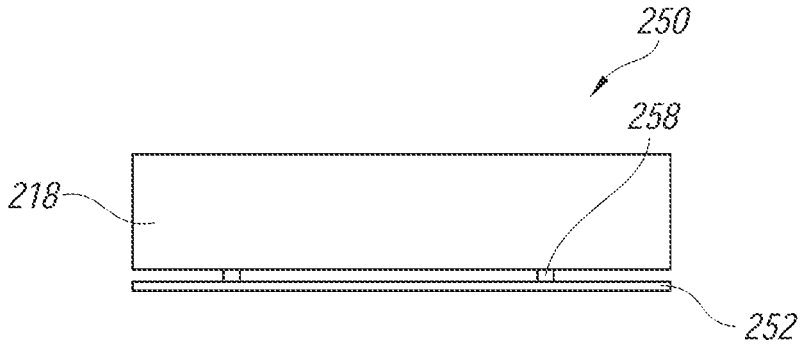
FIG. 2 is a partially schematic front view of one embodiment of a decarbonization system configured in accordance with embodiments of the technology.

FIG. 2 is a front view of a decarbonization system 250 configured in accordance with embodiments of the technology. The decarbonization system 250 can include a pushing ram head 218 and one or more scraping plates 252 coupled to the ram head 218 by one or more couplers 258. The pushing ram head 218 can be coupled to a pushing or discharge ram such as the discharge ram 18 described above with reference to FIG. 1A. In various embodiments, the scraping plate 252 can include a generally rigid surface made, for example, of steel, steel alloy, ceramic, or other refractory materials that are suitable for scraping or otherwise pushing coking deposits from a coke oven. The rigid surface may include one or more various grooves or scraping projections presented in one or more different scraping patterns. In such embodiments, one or more patterns of scraping projections may be used to provide increased localized pressure on the coking deposits. In other embodiments, surfaces of the scraping plate 252 are covered or at least partially embedded with abrasive materials, including ceramics, aluminum oxides, rubies, sapphires, diamonds, and the like. In some embodiments, the scraping plate 252 can have a vertical thickness from about 0.25 inch to about 3 inches, and in particular embodiments, has a thickness of about 0.75 inch. In various embodiments, the scraping plate 252 can extend across the entire width of the oven or a portion of the oven. In some embodiments, one or more scraping plates 252 may be coupled with the bottom and/or one or both sides of the ram head 218. It is further contemplated that embodiments of the decarbonization system 250 may position the scraping plates 252 behind the ram head 218, such as beneath a pusher ram arm that extends from the ram head 218.

In some embodiments, the couplers 258 are movable to allow the scraping plate 252 to vertically adjust to follow the contour of the oven floor. For example, in some embodiments, the couplers 258 can include a spring-loaded or hydraulic feature to provide scraping plate 252 adjustability. In further embodiments, the couplers 258 can be fixed to prevent such adjustability. In some embodiments, if the oven floor is not level, the scraping plate 252 can ride over high points and fill in low points with deposits, providing the benefit of keeping a thin, protective, and lubricating layer of clinker or other deposits on the floor.

Figure 3A:
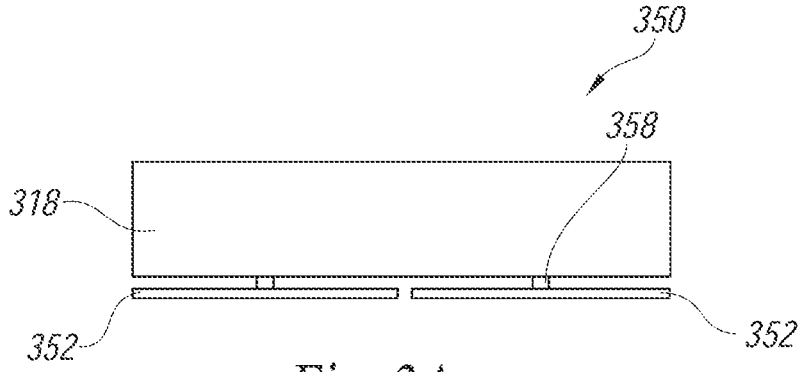
FIG. 3A is a partially schematic front view of one embodiment of a decarbonization system configured in accordance with embodiments of the technology.

FIG. 3A is a front view of a decarbonization system 350 configured in accordance with further embodiments of the technology. The decarbonization system 350 includes several features of the decarbonization system 250 described above. For example, the decarbonization system 350 includes a pushing ram head 318 configured to push coke and/or coking deposits from a coke oven. The decarbonization system 350 further includes a plurality of scraping plates 352 coupled to the pushing ram head 318 by a plurality of couplers 358. While the illustrated embodiment illustrates two scraping plates 352 oriented side-by-side across the width of the pushing ram head 318, in further embodiments, the decarbonization system 350 can include any number of scraping plates 352 in side-by-side, angled, or other configurations across the pushing ram head 318. In some embodiments, using multiple scraping plates 352 can allow the decarbonization system 350 to more finely follow the contours of a non-level oven floor. Further, while the illustrated embodiment illustrates a single coupler 358 attaching each scraping plate 352 to the pushing ram head 318, in further embodiments, multiple couplers per scraping plate 352 may be used or the scraping plates 352 can be coupled to or integrate directly with the pushing ram head 318 without an intermediate coupler.

Figure 3B:
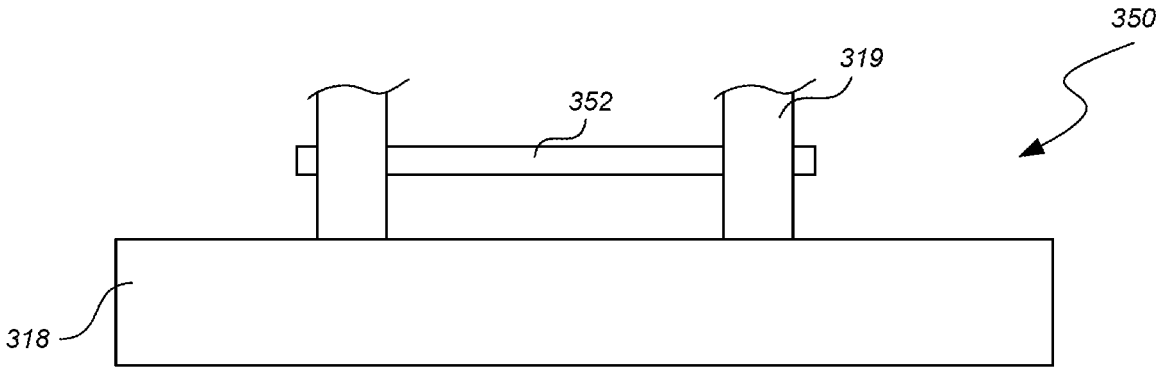
FIG. 3B is a partially schematic top view of another embodiment of a decarbonization system configured in accordance with embodiments of the technology.
Figure 3C:
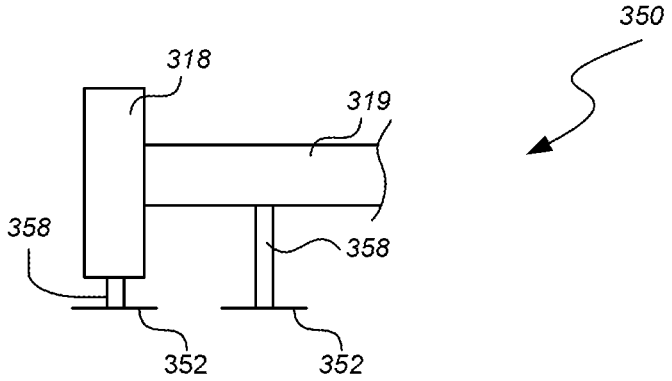
FIG. 3C is a partially schematic side view of the decarbonization system depicted in FIG. 3B.
Figure 3D:
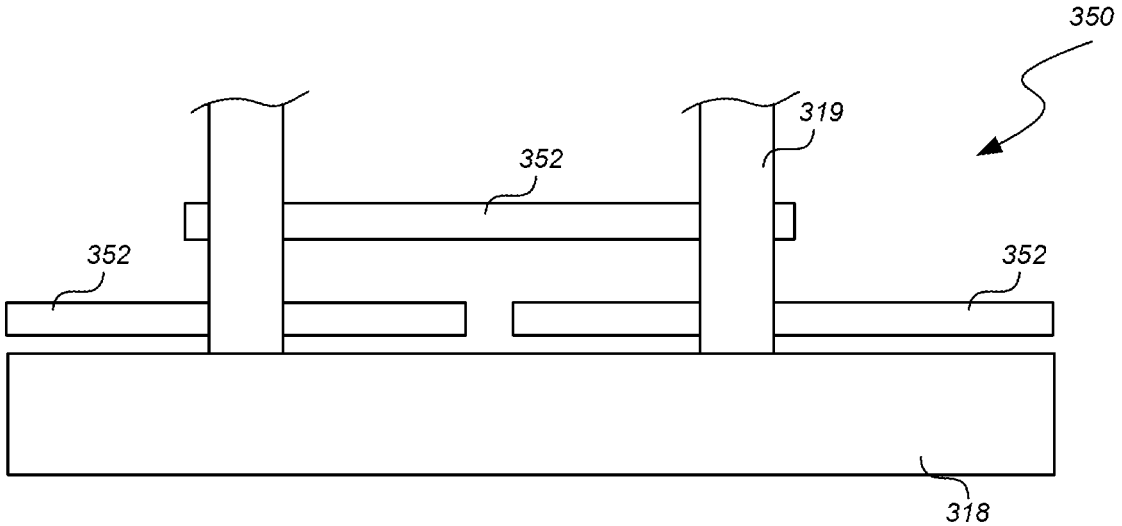
FIG. 3D is a partially schematic top view of a further embodiment of a decarbonization system configured in accordance with embodiments of the technology.

FIG. 3B is a top, plan view of a decarbonization system 350 configured in accordance with further embodiments of the technology. In this embodiment, the decarbonization system 350 is similar to the decarbonization system 350 depicted in FIG. 3A. However, FIG. 3B depicts an embodiment where the decarbonization system includes an additional scraping plate 352 that is coupled with the pushing ram arm 319. With reference to FIG. 3C, a side elevation view of the decarbonization system 350 is depicted. In this embodiment, the additional scraping plate 352 is coupled with the pushing ram arm 319 with one or more couplers 358. With reference to FIG. 3A, the forward two scraping plates 352 are oriented side-by-side across the width of the pushing ram head 318, which forms a gap between the opposing ends of the forward two scraping plates 352. In the embodiment depicted in FIGS. 3B and 3C, the additional scraping plate 352 is positioned rearwardly from the forward two scraping plates 352 and oriented so that a length of the additional scraping plate 352 is positioned behind the gap. Accordingly, the three scraping plates 352 substantially cover the width of the pushing ram head 318. In still other embodiments, such as depicted in FIG. 3D, it is contemplated that the forward two scraping plates 352 could be coupled with the pushing ram arms 319, rather than the pushing ram head 318, as depicted in FIGS. 3A-3C.

Figure 3E:
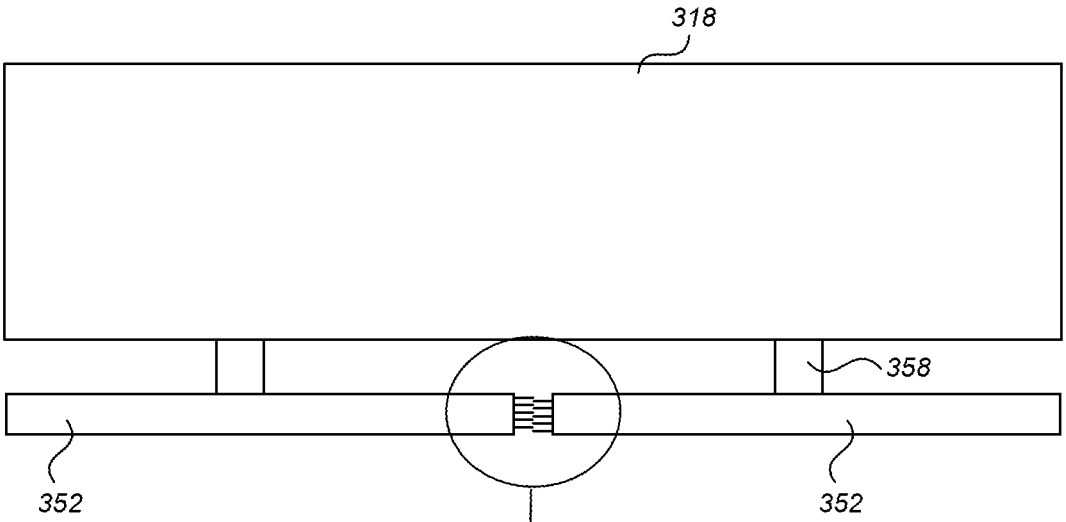
FIG. 3E is a partially schematic front view of another decarbonization system configured in accordance with further embodiments of the technology.
Figure 3F:
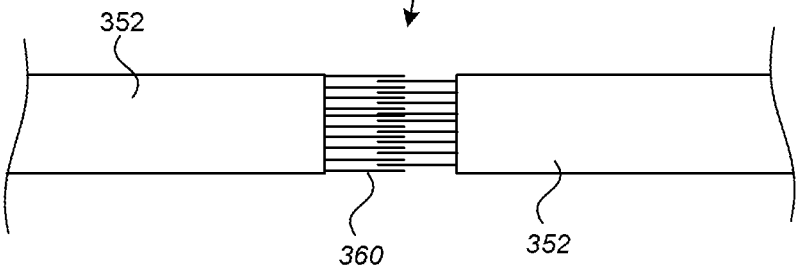
FIG. 3F is a partially schematic isometric view of a portion of the decarbonization system depicted in FIG. 3E.

FIGS. 3E and 3F depict another embodiment of the decarbonization system 350 configured in accordance with further embodiments of the technology. In this embodiment, the decarbonization system 350 is similar to the decarbonization system 350 depicted in FIGS. 3A-3D. However, FIGS. 3E and 3F depict an embodiment where a gap between the opposing ends of the forward two scraping plates 352 is spanned by one or more resiliently deformable scraping features or, in the depicted embodiment, a plurality of elongated bristles 360. In the depicted embodiment, the elongated bristles 360 extend outwardly from the opposite end portions of the forward two scraping plates 352 such that lengths of opposing elongated bristles 360 pass or overlap one another. In some embodiments, the elongated bristles 360 are formed from steel, a steel alloy, or other materials capable of withstanding the temperatures of the coke oven and, while deformably resistant, provide an ability to scrape and remove at least some of the coking deposits in which they come into contact. The elongated bristles 360 are depicted as being straight and aligned in a parallel, spaced-apart, fashion. However, it is contemplated that the elongated bristles could be curved, angular, looped, or other known shapes. It is also contemplated that the elongated bristles 360 could overlap one another or angle upwardly or downwardly with respect to the forward two scraping plates 352. In various embodiments the elongated bristles 360 can be replaceable. In such embodiments, sections or portions of the elongated bristles 360 may be removably or permanently secured in position.

Figure 4A:
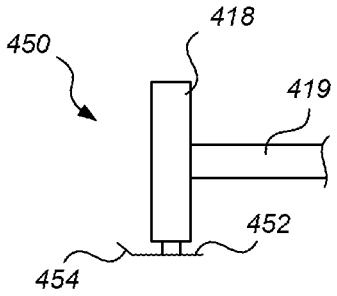
FIG. 4A is a partially schematic side view of one embodiment of a decarbonization system configured in accordance with embodiments of the technology.

FIG. 4A is a side view of a decarbonization system 450 configured in accordance with embodiments of the technology. The decarbonization system 450 includes several features generally similar to the decarbonization systems described above. For example, a scraping plate 452 is coupled to a pushing ram head 418. The pushing ram arm 419 can support and retractably drive the pushing ram head 418. In the illustrated embodiment, the scraping plate 452 includes a beveled edge 454 to define a scraping ski with a single shovel and tip. In various embodiments, the beveled edge 454 can be on either the pushing side or the following side of the scraping plate 452. In some embodiments, the beveled edge can allow the scraping plate 452 to ride along the oven floor without tearing up or digging into the floor material (e.g., brick). The beveled edge 454 may be smooth or include one or more various grooves or scraping projections presented in one or more different scraping patterns. A plurality of scraping plates 452 may be positioned adjacent one another in one of various patterns, side by side, or in a stacked, following configuration.

Figure 4B:
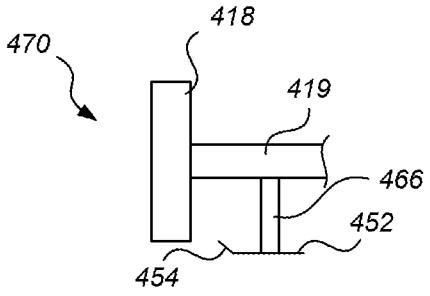
FIG. 4B is a partially schematic side view of another embodiment of a decarbonization system configured in accordance with embodiments of the technology.

FIG. 4B is a partially schematic side view of a decarbonization system 470 configured in accordance with further embodiments of the technology. The decarbonization system 470 is generally similar to the decarbonization system 450 described above with reference to FIG. 4A. However, in the embodiment illustrated in FIG. 4B, the scraping plate 452 is coupled to (e.g., descends from) a pushing ram arm 419 instead of the pushing ram head 418. The pushing ram arm 419 can support and retractably drive the pushing ram head 418. The scraping plate 452 can be coupled to the pushing ram arm 419 by a coupler 466. The coupler 466 can be fixed or movable, such as spring-loaded. In particular embodiments, the coupler 466 can provide an adjustable height mechanism to adjust a height of the scraping plate 452 relative to the pushing ram head 418 and the oven floor. In various embodiments, a lower surface of the scraping plate 452 can be generally coplanar or slightly above or below a lower surface of the pushing ram head 418. The relative height of the pushing ram head 418 and scraping plate 452 can be selected to best smooth and clean the oven floor without interfering with coke-pushing operations. While the scraping plate 452 is shown on a following side of the pushing ram head 418, in further embodiments, it can be on a leading side of the pushing ram head 418. Further, the scraping plate 452 or other scraping or scoring device can alternatively or additionally be coupled to the pushing ram head 418 or other location in the decarbonization system 470.

Embodiments of the decarbonization system 470 may be provided with one or more scraping plates 452 having a wide array of different configurations. For example, a scraping plate 452, coupled with the coupler 466, may be provided with a pair of beveled edges 454, positioned at opposite end portions of the scraping plate 452. In this manner, a beveled edge 454 defines a leading edge portion of the scraping plate in either direction that the decarbonization system 470 is moved along a length of the oven. In some embodiments, the pair of beveled edges 454 may be provided with lengths that are equal or dissimilar to one another. Embodiments of the scraping plates 452 may present the beveled edges 454 to extend upwardly from a generally horizontal base plate of the scraping plate 452 at an angle approximating forty five degrees. However, other embodiments may present the beveled edges to extend upwardly at an angle that is at least slightly less than or greater than forty five degrees. Similarly, embodiments of the scraping plates 452 may include chamfered or rounded edges where the beveled edges 454 meet the horizontal base plate, depending on the desired level of ease with which the scraping plates 452 engage edges or irregular surfaces of the coking deposits and the oven floor.

Figure 5:
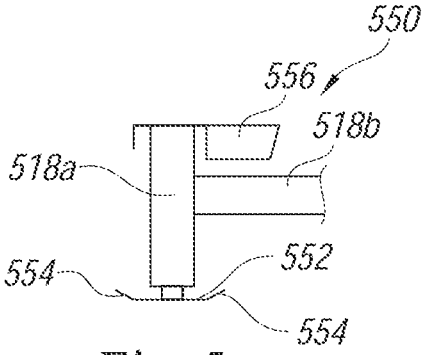
FIG. 5 is a partially schematic side view of a further embodiment of a decarbonization system configured in accordance with still further embodiments of the technology.

FIG. 5 is a side view of a decarbonization system 550 configured in accordance with further embodiments of the technology. Like the systems described above, the decarbonization system 550 includes a scraping plate 552 coupled to a pushing ram head 518. The scraping plate 552 includes beveled edges 554 on both pushing and following sides of the scraping plate 552 to define a scraping ski with a pair of opposing shovels and tips. One or both of the beveled edges 554 may be smooth or include one or more various grooves or scraping projections presented in one or more different scraping patterns. A plurality of scraping plates 552 may be positioned adjacent one another in one of various patterns, side by side, or in a stacked, following configuration.

The decarbonization system 550 can further include a weight or ballast 556 configured to weigh down the decarbonization system 550 against the coke oven floor. In various embodiments, the ballast 556 can be coupled to a pushing ram (e.g., the pushing ram head 518 or other portion of a pushing ram) or the scraping plate 552. In further embodiments, there can be more or fewer ballasts 556. In particular embodiments, the ballast 556 comprises steel, a steel alloy, or other refractory materials. In some embodiments, the pushing ram head 518 or scraping plate 552 can be uniformly or non-uniformly weighted to achieve consistent or varied downward pressure as desired.

Figure 6:
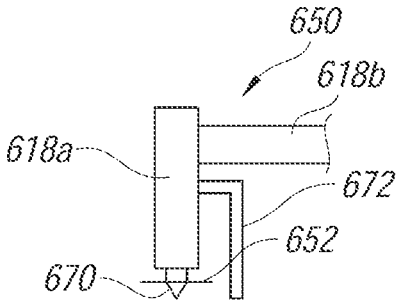
FIG. 6 is a partially schematic side view of still another embodiment of a decarbonization system configured in accordance with additional embodiments of the technology.

FIG. 6 is a side view of a decarbonization system 650 configured in accordance with additional embodiments of the technology. The decarbonization system 650 includes a generally flat (e.g., non-beveled) scraping plate 652 coupled to a pushing ram head 618. In embodiments having more than one scraping plate 652, a combination of beveled and non-beveled plates can be used.

The decarbonization system 650 further includes various scoring features to create grooves or breaks in the coking deposits. For example, in the illustrated embodiment, the decarbonization system 650 includes scoring teeth 670 along a bottom surface of the scraping plate 652 and a scoring bar 672 extending outward and downward from the pushing ram head 618. The teeth 670 and bar 672 can groove or score the surface of the coke, leading to fractures that break apart the highly-compacted deposits into more easily removable pieces. In still further embodiments, other scoring features such as a wheel, impactor, cutter, etc. can be used.

In some embodiments, the deposits having been broken apart by the scoring features can be more readily pushed or otherwise removed from the coke oven. In various embodiments, the scoring features can be used in conjunction with pushing the deposits from the oven, or can be used separately. For example, in some embodiments, the deposits can be scored each time the deposits are scraped from the oven. In further embodiments, scoring the deposits can occur more frequently than scraping the deposits because the scoring reduces the need for high-pressure scraping. In other embodiments, scoring the deposits can occur less frequently than scraping the deposits. In still further embodiments, a scoring feature may be coupled to a coke pushing ram while the scraping plate 652 is coupled to a separate decarbonization pushing ram that follows the coke pushing ram.

The scoring features can be positioned on a pushing and/or following side of the pushing ram head 618, the scraping plate 652, on another device altogether (e.g., a pushing ram arm), or in a combination of these positions. Further, various embodiments can include scoring features across (or partially across) the width and/or depth of the pushing ram head 618. Additionally, various scoring features may be used individually or in combination. For example, while the decarbonization system 650 includes both scoring teeth 670 and a scoring bar 672, in further embodiments, only one of these scoring features (or other scoring features) may be used.

Figure 7:
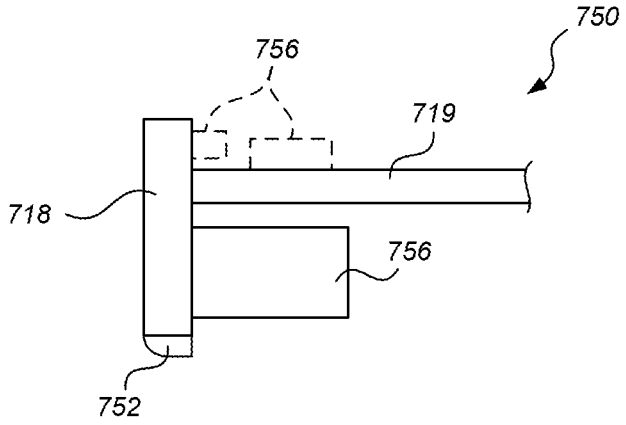
FIG. 7 is a partially schematic side view of another embodiment of a decarbonization system configured in accordance with embodiments of the technology.

FIG. 7 is a side view of a decarbonization system 750 configured in accordance with further embodiments of the technology. The decarbonization system 750 includes a scraping plate 752 coupled to a pushing ram head 718 that is driven by a pushing ram arm 719. The scraping plate 752 includes at least one rounded edge. Like the beveled scraping plates described above, the rounded edge on the scraping plate 752, shown in FIG. 7, can prevent the scraping plate 752 from causing tear-out in the oven floor. Instead, the rounded edge can scrape or push the coking deposits from the oven floor while riding on the floor. While the rounded edge is shown on the pushing side of the pushing ram head 718, in further embodiments, it can be on the following side.

The decarbonization system 750 can further include an optional weight or ballast 756 to pressure the pushing ram head 718 and scraping plate 752 downward against the floor to improve contact and deposit clean-out. For example, in the illustrated embodiment, the ballast 756 is shown coupled to the pushing ram head 718. In further embodiments, one or more ballasts 756 can additionally or alternately be coupled to the pushing ram arm 719, the scraping plate 752, or can be integral to any of these features. Some example locations for alternate or additional placement of the ballasts 756 are shown in dashed lines.

Figure 8:
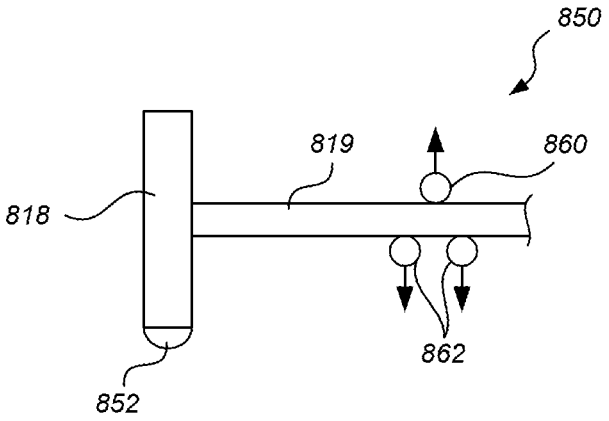
FIG. 8 is a partially schematic side view of a further embodiment of a decarbonization system configured in accordance with embodiments of the technology.

FIG. 8 is a side view of a decarbonization system 850 configured in accordance with still further embodiments of the technology. The decarbonization system 850 includes a scraping plate 852 coupled to a pushing ram head 818 that is driven by a pushing ram arm 819. The scraping plate 852 can be rounded on both the pushing and following sides to prevent tear-out on the oven floor during both extension and retraction motions of the pushing ram arm 819 relative to the coking chamber. In some embodiments, the scraping plate 852 may not be provided in a planar, plate-like configuration. Rather, some embodiments of the decarbonization system may use an elongated pipe having a plurality of holes disposed along a length of the pipe. An oxidant, such as air or oxygen, may be directed through the pipe and the holes at a rate that burns at least some, if not a substantial portion, of the coking deposits.

The decarbonization system 850 can further include a plurality of rollers (e.g., an upper roller 860 and lower rollers 862) attached to a pushing support structure (e.g., a pushing/charging machine, not shown) that is configured to support and allow for retractable movement of the pushing ram arm 819. In addition, or as an alternative to the weight systems described above which encourage contact between the scraping plate 852 and the oven floor, in some embodiments, the rollers 860, 862 can be adjusted to provide a generally similar force. For example, the upper roller 860 can be adjusted upward and/or the lower rollers 862 can be adjusted downward (in the direction of the arrows) to add downward force to the cantilevered pushing ram head 818 and/or scraping plate 852. The same relationship can apply regardless of whether the scraping plate 852 is attached to the pushing ram head 818 as shown or directly to the pushing ram arm 819 as shown in FIG. 4B.

Figure 9A:
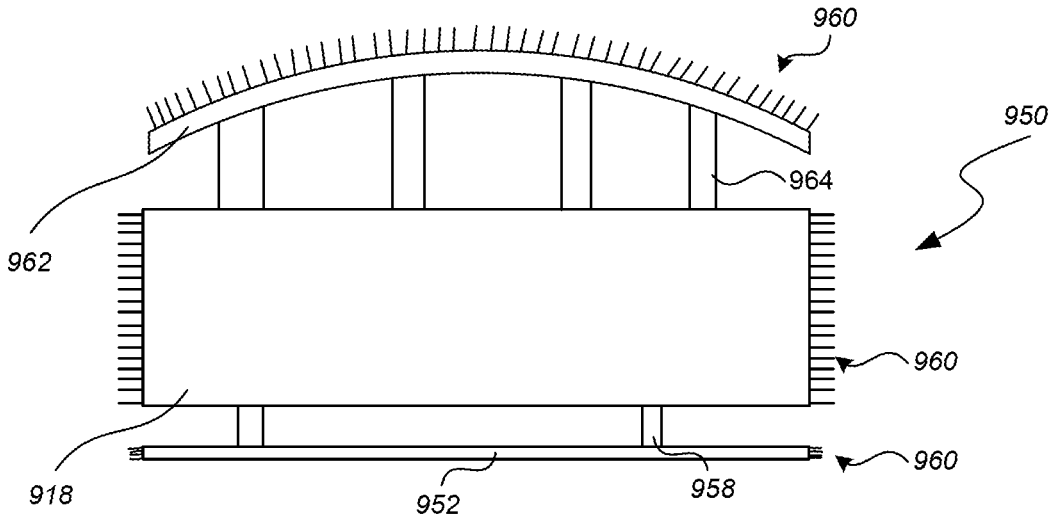
FIG. 9A is a partially schematic front view of another embodiment of a decarbonization system configured in accordance with embodiments of the technology.

FIG. 9 is a front view of a decarbonization system 950 configured in accordance with embodiments of the technology. The decarbonization system 950 can include a pushing ram head 918 and one or more scraping plates 952 coupled to the ram head 918, or one or more pushing ram arms (not depicted), by one or more couplers 958. The pushing ram head 918 can be coupled to a pushing or discharge ram such as the discharge ram 18 described above with reference to FIG. 1A. In various embodiments, the scraping plate 952 will be constructed in a manner similar to other scraping plates or features described above. However, in certain embodiments, one or more resiliently deformable scraping features or, in the depicted embodiment, a plurality of elongated bristles 960 extend outwardly from different features of the decarbonization system 950. For example, the elongated bristles 960 are depicted as extending outwardly from the opposite end portions of the scraping plate 952 and opposite side portions of the pushing ram head 918. When positioned as depicted, the elongated bristles 960 follow contours of the sidewalls of the coke oven as the decarbonization system 950 is pushed and retracted through the coke oven. The deformable nature of the elongated bristles 960 allow the elongated bristles 960 to follow irregular surfaces better than rigid scraping features. Similarly, elongated bristles may be positioned to extend upwardly from a support frame 962 that is supported by connectors 964 on top of the pushing ram head 918 or pushing ram arms 919. In this manner, the elongated bristles 960 may be positioned to follow contours of the crown of the coke oven as the decarbonization system 950 is pushed and retracted through the coke oven. In some embodiments, the elongated bristles 960 are formed from steel, a steel alloy, or other materials capable of withstanding the temperatures of the coke oven and, while deformably resistant, provide an ability to scrape and remove at least some of the coking deposits in which they come into contact. The elongated bristles 960 are depicted as being straight and aligned in a parallel, spaced-apart, fashion. However, it is contemplated that the elongated bristles could be curved, angular, looped, or other known shapes.

Figure 9B:
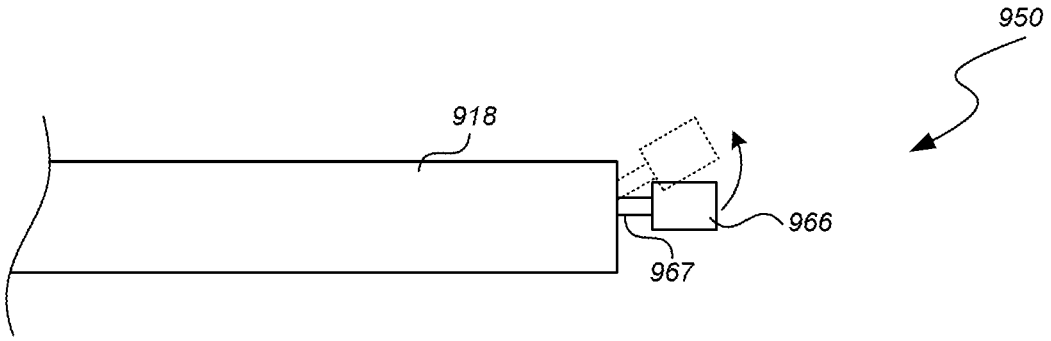
FIG. 9B is a partially schematic top view of a further embodiment of a decarbonization system configured in accordance with embodiments of the technology.
Figure 9C:
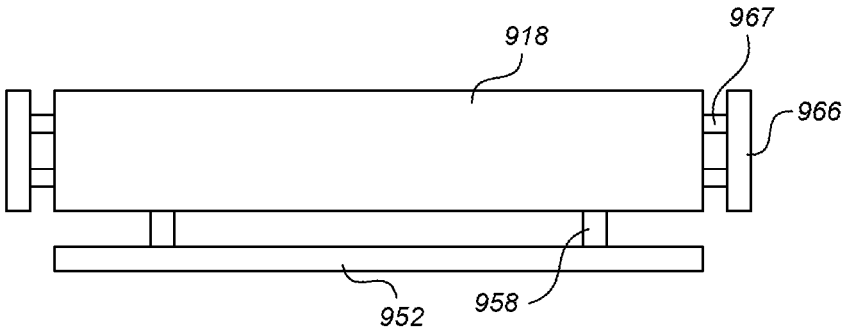
FIG. 9C is a partially schematic front view of the decarbonization system depicted in FIG. 9B.

FIG. 9B and FIG. 9C depict another embodiment of the decarbonization system 950 configured in accordance with embodiments of the technology. The depicted embodiment of the decarbonization system 950 includes a pushing ram head 918 and one or more scraping plates 952 coupled to the ram head 918, or one or more pushing ram arms (not depicted), by one or more couplers 958. In the depicted embodiment, the decarbonization system 950 includes resiliently deformable scraping features or, in the depicted embodiment, resilient scraping plates 966 that are connected to opposite side portions of the pushing ram head 918 by resiliently deformable couplers 967. When positioned as depicted, the scraping plates 960 follow contours of the sidewalls of the coke oven as the decarbonization system 950 is pushed and retracted through the coke oven. The deformable nature of the resiliently deformable couplers 967 allow the scraping plates 960 to extend and retract from the pushing ram head 918 and follow varying distances from the decarbonization system 950 and the coke oven walls. The scraping plates 960 may be formed from materials similar to those used to form the scraping plate 952, such as steel, steel alloys, ceramic, and the like. In some embodiments, the resiliently deformable couplers 967 are formed from steel, a steel alloy, or other materials capable of withstanding the temperatures of the coke oven and, while deformably resistant, sufficiently durable to support the scraping plates 960 while they scrape the sidewalls of the coke oven.

Figure 10A:
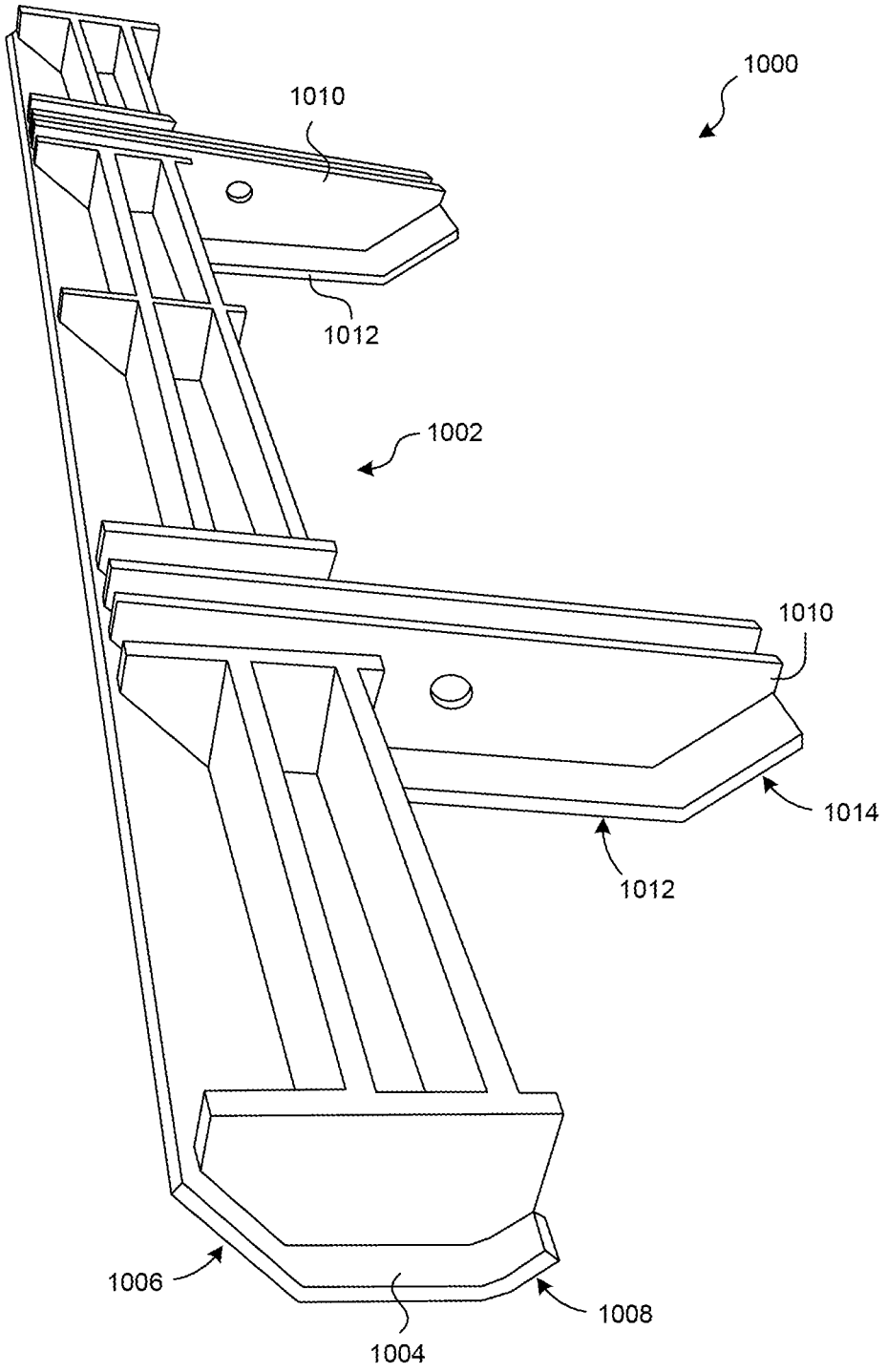
FIG. 10A depicts a partial side perspective view of one embodiment of a decarbonization system configured in accordance with further embodiments of the technology.
Figure 10B:
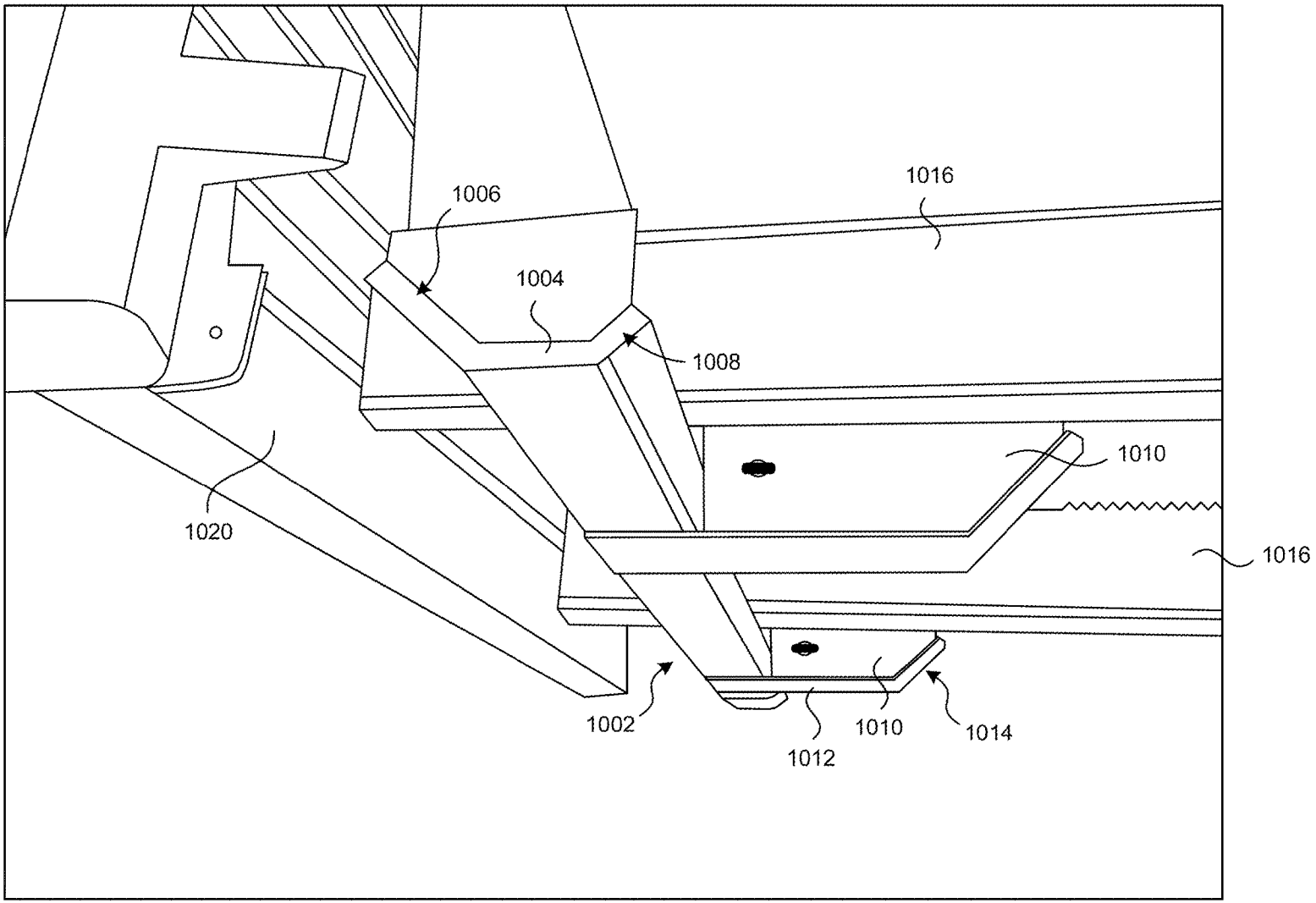
FIG. 10B depicts a side perspective view of the decarbonization system depicted in FIG. 10A and depicts one manner in which it may be coupled with a pushing ram.

FIG. 10A and FIG. 10B depict an embodiment of a scraper 1000 that may be used with a decarbonization system configured in accordance with embodiments of the technology. In the depicted embodiment, the scraper 1000 includes an elongated scraper body 1002 having a scraping plate 1004 having a forward beveled edge 1006 and a rearward beveled edge 1008. In various embodiments, the scraping plate 1004 can include a generally rigid surface made, for example, of steel, steel alloy, ceramic, or other refractory materials that are suitable for scraping or otherwise pushing coking deposits from a coke oven. The rigid surface may include one or more various grooves or scraping projections presented in one or more different scraping patterns. In such embodiments, one or more patterns of scraping projections may be used to provide increased localized pressure on the coking deposits. In other embodiments, surfaces of the scraping plate 1004 are covered or at least partially embedded with abrasive materials, including ceramics, aluminum oxides, rubies, sapphires, diamonds, and the like. In some embodiments, the scraping plate 1004 can have a vertical thickness from about 0.25 inch to about 3 inches, and in particular embodiments, has a thickness of about 0.75 inch. In various embodiments, the scraping plate 1004 can extend across the entire width of the oven or a portion of the oven.

The scraper 1000 further includes a plurality of elongated scraper shoes 1010 coupled to the scraper body 1002 so that the scraper shoes 1010 are horizontally spaced apart from one another. In various embodiments, the scraper shoes 1010 extend rearwardly and perpendicularly from the scraper body 1002. The scraper shoes 1010 include scraping skis 1012 that include a generally rigid surface made, for example, of steel, steel alloy, ceramic, or other refractory materials that are suitable for scraping or otherwise pushing coking deposits from a coke oven. As with the scraping plate, the rigid surface of the scraping skis 1012 may include one or more various grooves or scraping projections presented in one or more different scraping patterns and may be covered or at least partially embedded with abrasive materials, including ceramics, aluminum oxides, rubies, sapphires, diamonds, and the like. In some embodiments, the scraping skis 1012 have a vertical thickness from about 0.25 inch to about 3 inches, and in particular embodiments, has a thickness of about 0.75 inch. The scraping skis 1012 include a forward beveled edge (not depicted) and a rearward beveled edge 1014. The forward beveled edge and rearward beveled edge 1014 may extend upwardly from the bottom of the scraping skis 1012 at various angles according to the intended scraping operations. In the depicted embodiment, the forward beveled edge and rearward beveled edge 1014 extend upwardly from the base of the scraping ski at forty-five degree angles. With reference to FIG. 10B, the scraper 1000 may be coupled to the ram head arms 1016 of a pushing ram by one or more couplers (not depicted). It is contemplated, however, that the scraper 1000 be coupled to a pushing ram head 1020.

Figure 11:
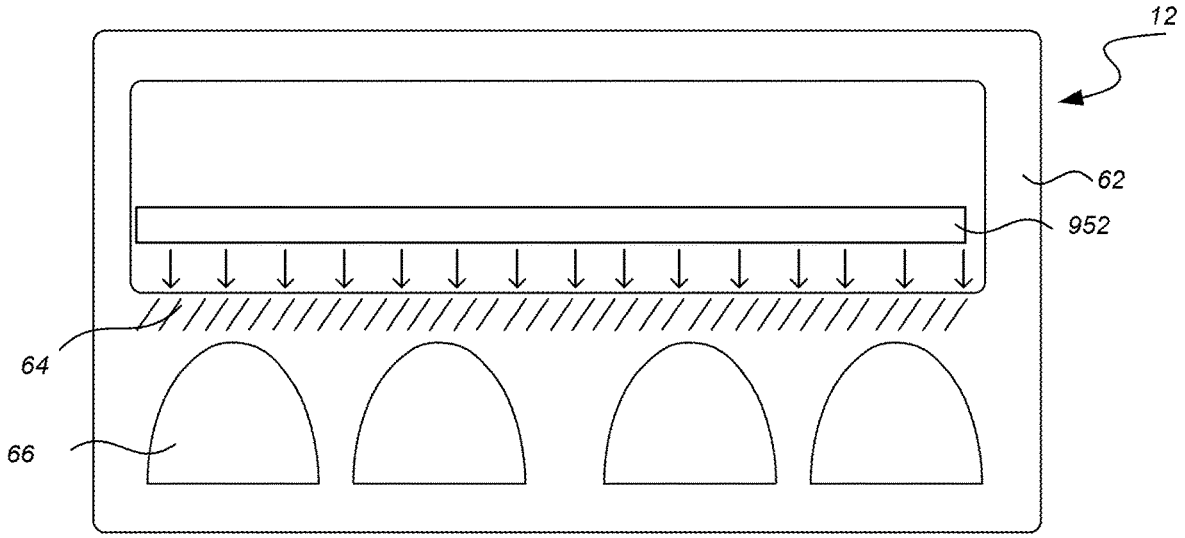
FIG. 11 is a partially schematic front view of one embodiment of a decarbonization system configured in accordance with embodiments of the technology and depicts one manner in which it may engage a floor of a coke oven.
Figure 12:
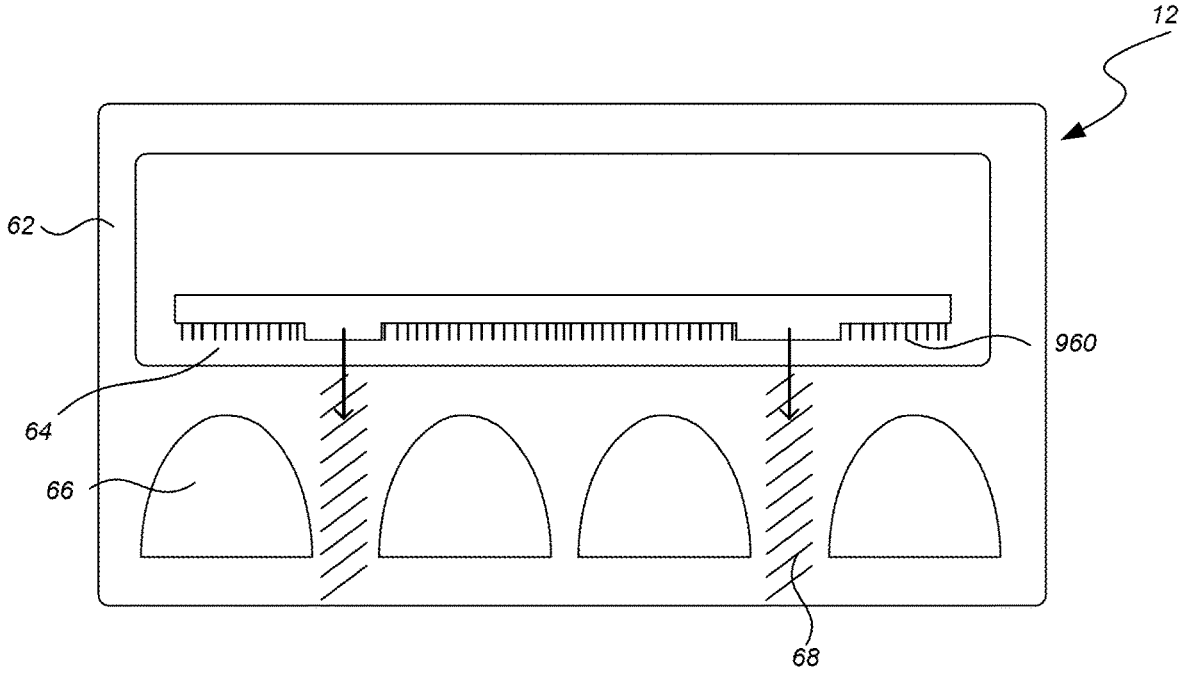
FIG. 12 is a partially schematic front view of another embodiment of a decarbonization system configured in accordance with embodiments of the technology and depicts one manner in which it may engage a floor of a coke oven.

In various embodiments, bottom surfaces of the scraping skis 1012 are positioned to be co-planar with one another. In some embodiments, the bottom surfaces of the scraping surfaces 1012 are positioned to be co-planar with a bottom surface of the scraper body 1002. In such instances, the scraper 1000 has a uniform bottom surface and any weight received by the coke oven floor from the scraper 1000 is evenly disbursed across the coke oven floor 64. FIG. 11 depicts a front schematic representation of such embodiments. In such embodiments, however, it is contemplated that the crown portions of the sole flues 66 may be damaged under the weight of the decarbonization system. In other embodiments, however, the bottom surfaces of the scraping surfaces 1012 are positioned to be parallel but beneath a plane in which the bottom surface of the scraper body 1002 resides. In some embodiments, the two planes may be separated by less than an inch. In other embodiments, it may be by two or three inches, depending on the conditions present in the coking oven. FIG. 12 depicts such an embodiment. The scraper shoes 1010 are positioned along a length of the scraper body 1002 so that the scraper shoes 1010 are positioned above, and aligned with, sole flue walls 68 associated with the sole flues 66. In this manner, a substantial portion of any weight received by the coke oven floor 64 from the scraper 1000 is received by the sole flue walls 68 of the sole flues 66. Moreover, greater support is afforded to the decarbonizing system and the sole flues 66 are less likely to be damaged by scraping operations. Such embodiments of the scraper 1000 further provide the opportunity to have one or more resiliently deformable scraping features or, in the depicted embodiment, a plurality of elongated bristles 1060 extend outwardly from different features of the scraper 1000. For example, the elongated bristles 1060 are depicted as extending outwardly from the bottom surface of the scraping plate 1004 on either side of the scraping shoes 1010. In this manner, additional scraping of coking deposits may occur without transferring more weight to the other areas of the coke oven floor 64.

Figure 13:
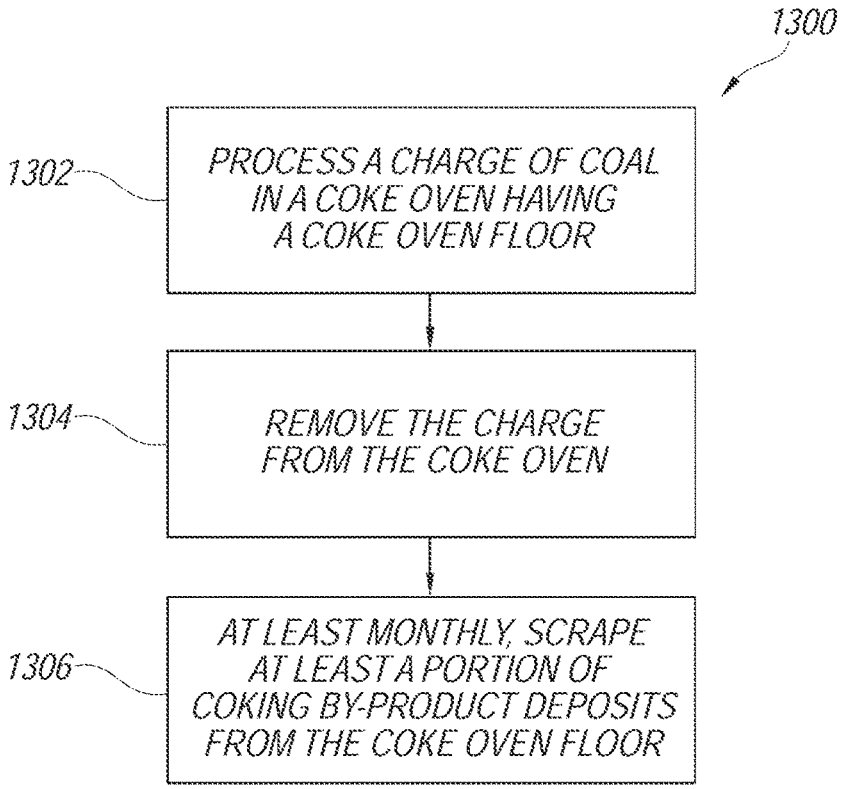
FIG. 13 is a block diagram illustrating a method of decarbonizing a coke oven in accordance with embodiments of the technology.

FIG. 13 is a block diagram illustrating a method 1300 of decarbonizing a coke oven of coking deposits in accordance with embodiments of the technology. At bock 1302, the method 1300 can include processing a charge of coal in the coke oven. In several embodiments, the coke oven comprises a floor, a crown, and a plurality of sidewalls connecting the floor and the crown. In some embodiments, the charge of coal comprises loose, non-stamp-charged coal. At block 1304, the method 1300 can include removing the charge from the coke oven. At block 1306, the method 1300 can include scraping at least a portion of coking deposits from the coke oven floor, wherein the scraping is performed at least monthly. In various embodiments, the scraping can occur simultaneously with, before, or after the charge-removing step. In particular embodiments, the scraping can occur at least weekly, at least daily, or each time the charge is inserted or removed from the coke oven. In various embodiments, the scraping is performed by running a scraper along or over the coke oven floor one or a plurality of times.

In various embodiments, the scraping can be performed using any of the decarbonization systems described above. For example, in some embodiments, the scraping includes using a scraper having at least one rounded or beveled edge proximate to the coke oven floor. In further embodiments, the scraping includes using a scraper having one or more plates that substantially follow a contour of the coke oven floor during scraping. In particular embodiments, the scraper is at least partially made of steel, a steel alloy, or a ceramic material. In some embodiments, the scraping is performed by a scraper including a ram head having a ballast coupled thereto. In some embodiments, the method 1300 can further include scoring a surface of the deposits using any scoring feature such as those described above.

Figure 14:
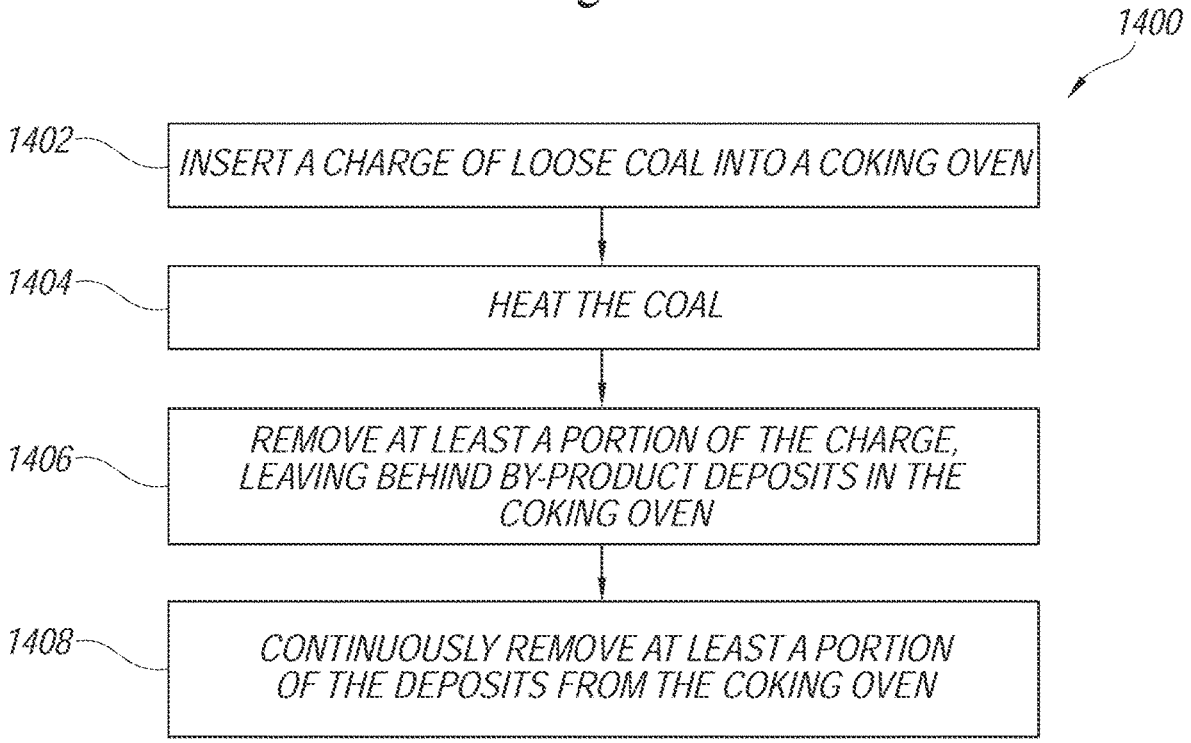
FIG. 14 is a block diagram illustrating a method of operating a coke oven in accordance with embodiments of the technology.

FIG. 14 is a block diagram illustrating a method 1400 of operating a coking oven in accordance with embodiments of the technology. At blocks 1402 and 1404, the method 1400 can include inserting a charge of loose coal into the coking oven and heating the coal. At block 1406, the method 1400 can include removing at least a portion of the charge, leaving behind coking deposits in the coking oven. At block 1408, the method 1400 can include continuously removing at least a portion of the deposits from the coking oven. For example, in various embodiments, the deposits can be removed from the coking oven at least daily or each time a new charge of coal is inserted in the coking oven. In some embodiments, the method can further include maintaining a substantially level surface on a floor of the coking oven.

EXAMPLES

The following Examples are illustrative of several embodiments of the present technology.

1. A method of decarbonizing a coke oven of coking deposits, the method comprising:
   - processing a charge of coal in the coke oven, wherein the coke oven comprises a plurality of interior surfaces including a floor, a crown, and sidewalls that extend between the floor and the crown;
   - removing the charge from the coke oven; and
   - removing coking deposits from the coke oven, while removing the charge from the coke oven.

2. The method of example 1 wherein removing coking deposits from the coke oven comprises scraping at least a portion of the coking deposits with a scraper operatively coupled to a pushing ram.

3. The method of example 1 wherein removing coking deposits from the coke oven comprises scraping the coking deposits with a scraper having at least one rounded or beveled edge adjacent at least one interior surface of the coke oven.

4. The method of example 1 wherein removing coking deposits from the coke oven comprises scraping the coking deposits with a scraper having one or more plates that substantially follow a contour of at least one of the interior surfaces of the coke oven during scraping.

5. The method of example 1, further comprising scoring a surface of the coking deposits.

6. The method of example 1 wherein removing coking deposits from the coke oven comprises running a scraper along at least one interior surface of the coke oven a single time, whereby the scraper is pushed along a length of the coke oven and then retracted along the length of the coke oven.

7. The method of example 1 wherein removing coking deposits from the coke oven comprises running a scraper over at least one interior surface of the coke oven a plurality of times.

8. The method of example 7 wherein removing coking deposits from the coke oven comprises scraping the coking deposits with a scraper comprised of at least one deformably resilient scraping feature that substantially follows a contour of at least one of the interior surfaces of the coke oven during scraping.

9. The method of example 1 wherein removing coking deposits from the coke oven comprises scraping the coking deposits with a scraper comprised of steel, a steel alloy, or ceramics.

10. The method of example 1 wherein removing coking deposits from the coke oven comprises scraping the coking deposits with a scraper comprised of an abrasive.

11. The method of example 1 wherein removing coking deposits from the coke oven comprises scraping the coking deposits with a scraper operatively coupled to a pushing ram head of a pushing ram.

12. The method of example 11 wherein a weight is operatively coupled with the pushing ram.

13. The method of example 1 wherein removing coking deposits from the coke oven comprises scraping the coking deposits with a scraper operatively coupled to a pushing ram arm of a pushing ram.

14. The method of example 13 wherein a weight is operatively coupled with the pushing ram.

15. The method of example 1 wherein removing coking deposits from the coke oven comprises scraping coking deposits from a plurality of interior surfaces of the coke oven with a plurality of scrapers operatively coupled to a pushing ram.

16. The method of example 1 wherein removing coking deposits from the coke oven comprises scraping the coking deposits with a scraper comprised of at least one deformably resilient scraping feature that substantially follows a contour of at least one of the interior surfaces of the coke oven during scraping.

17. The method of example 16 wherein the at least one deformably resilient scraping feature includes a plurality of elongated bristles operatively coupled to a pushing ram such that free end portions of the bristles are directed toward the at least one interior surface of the coke oven.

18. The method of example 16 wherein the at least one deformably resilient scraping feature includes at least one elongated scraping bar operatively coupled to a pushing ram with at least one resiliently deformable hinge such that a leading edge portion of the at least one elongated scraping bar is positioned adjacent to the at least one interior surface of the coke oven.

19. The method of example 16 wherein the scraper includes a plurality of deformably resilient scraping features that substantially follow contours of a plurality of the interior surfaces of the coke oven during scraping.

20. The method of example 1 wherein removing coking deposits from the coke oven comprises scraping the coking deposits with a plurality of scrapers operatively coupled with a pushing ram.

21. The method of example 20 wherein the plurality of scrapers include at least two elongated scrapers operatively coupled with a pushing ram such that the elongated scrapers are positioned to be side by side one another with lengths of the scrapers extending perpendicular to a length of the coke oven during scraping.

22. The method of example 21 wherein the elongated scrapers are positioned to be coaxially aligned with one another and horizontally spaced apart to define a gap between the elongated scrapers.

23. The method of example 22 wherein the scraper includes a plurality of deformably resilient scraping features that extend outwardly from the elongated scrapers into the gap between the elongated scrapers.

24. The method of example 23 wherein the plurality of deformably resilient scraping features from the adjacent elongated scrapers intermesh with one another in the gap between the elongated scrapers.

25. The method of example 22 wherein the scraper includes a third elongated scraper operatively coupled with the pushing ram rearwardly from the at least two elongated scrapers and positioned so that a length of the third elongated scraper is behind the gap between the elongated scrapers to engage coking deposits that pass through the gap during scraping.

26. The method of example 1 wherein removing coking deposits from the coke oven comprises scraping the coking deposits with a scraper comprised of at least one deformably resilient scraping feature that substantially follows a contour of the crown of the coke oven during scraping.

27. The method of example 1 wherein removing coking deposits from the coke oven comprises scraping the coking deposits with a scraper comprised of at least one deformably resilient scraping feature that substantially follows a contour of the sidewalls of the coke oven during scraping.

28. The method of example 1 wherein removing coking deposits from the coke oven comprises scraping coking deposits on the floor of the coke oven wherein a flattened layer of coking deposits remains on the floor of the coking oven after scraping.

29. The method of example 1 wherein removing coking deposits from the coke oven comprises scraping at least a portion of the coking deposits with a scraper operatively coupled to a pushing ram; the scraper including an elongated scraper body extending perpendicular to a length of the coke oven during scraping and a plurality of elongated scraper shoes coupled to the scraper body so that the scraper shoes are horizontally spaced apart from one another and extending parallel to the length of the coke oven during scraping.

30. The method of example 29 wherein the plurality of scraper shoes include soles that are co-planar with one another and vertically spaced beneath a plane in which a sole of the scraper base resides, whereby a substantial portion of a scraper weight received by the coke oven floor is received beneath the soles of the scraper shoes during scraping.

31. The method of example 30 wherein the plurality of scraper shoes are positioned along a length of the scraper body so that the scraper shoes are positioned above, and aligned with, sole flue sole flue walls beneath the oven coke floor during scraping.

32. A coking system, comprising:

a coke oven comprising a plurality of interior surfaces including a floor, a crown, and opposing sidewalls between the floor and the crown;

a pushing ram configured to push a charge of coke from the oven; and a decarbonization system reciprocally movable along a length of the coke oven.

33. The system of example 32 wherein the decarbonization system is operatively coupled to the pushing ram.

34. The system of example 32 wherein the decarbonization system comprises a scraper having at least one rounded or beveled edge proximate at least one of the interior surfaces of the coke oven.

35. The system of example 34 wherein the decarbonization system comprises a scraper having at least one weight coupled thereto.

36. The system of example 32 wherein the decarbonization system comprises a scraper having one or more scraping features that substantially follow a contour of one or more interior surfaces of the coking oven.

37. The system of example 32 wherein the decarbonization system is comprised of steel, a steel alloy, or ceramics.

38. The system of example 32 wherein the decarbonization system is comprised of an abrasive.

39. The system of example 32 wherein the decarbonization system is operatively coupled to a pushing ram head of a pushing ram.

40. The system of example 39 wherein a weight is operatively coupled with the pushing ram.

41. The system of example 32 wherein the decarbonization system is operatively coupled to a pushing ram arm of a pushing ram.

42. The system of example 41 wherein a weight is operatively coupled with the pushing ram.

43. The system of example 32 wherein the decarbonization system is comprised of at least one deformably resilient scraping feature that is configured to substantially follow a contour of at least one of the interior surfaces of the coke oven during a scraping movement.

44. The system of example 43 wherein the at least one deformably resilient scraping feature includes a plurality of elongated bristles operatively coupled to a pushing ram such that free end portions of the bristles are directed toward the at least one interior surface of the coke oven.

45. The system of example 43 wherein the at least one deformably resilient scraping feature includes at least one elongated scraping bar operatively coupled to a pushing ram with at least one resiliently deformable hinge such that a leading edge portion of the at least one elongated scraping bar may be selectively positioned adjacent the at least one interior surface of the coke oven.

46. The system of example 32 wherein the decarbonization system is comprised of a plurality of scrapers operatively coupled to a pushing ram.

47. The system of example 46 wherein the plurality of scrapers include at least two elongated scrapers operatively coupled with a pushing ram such that the elongated scrapers are positioned to be side by side one another with lengths of the scrapers extending perpendicular to a length of the pushing ram.

48. The system of example 47 wherein the elongated scrapers are positioned to be coaxially aligned with one another and horizontally spaced apart to define a gap between the elongated scrapers.

49. The system of example 48 wherein the scraper includes a plurality of deformably resilient scraping features that extend outwardly from the elongated scrapers into the gap between the elongated scrapers.

50. The system of example 49 wherein the plurality of deformably resilient scraping features from the adjacent elongated scrapers intermesh with one another in the gap between the elongated scrapers.

51. The system of example 48 wherein the scraper includes a third elongated scraper operatively coupled with the pushing ram rearwardly from the at least two elongated scrapers and positioned so that a length of the third elongated scraper is behind the gap between the elongated scrapers.

52. The system of example 32 wherein the decarbonization system is comprised of at least one deformably resilient scraping feature that is positioned to extend upwardly from the decarbonization system and adapted to substantially follow a contour of the crown of the coke oven.

53. The system of example 32 wherein the decarbonization system is comprised of at least one deformably resilient scraping feature that is positioned to extend outwardly from side portions of the decarbonization system and adapted to substantially follow a contour of the sidewalls of the coke oven.

54. The system of example 32 wherein the decarbonization system is operatively coupled to a pushing ram; the decarbonization system including an elongated scraper body extending perpendicular to a length of the pushing ram and a plurality of elongated scraper shoes coupled to the scraper body so that the scraper shoes are horizontally spaced apart from one another, extending parallel to the length of the pushing ram.

55. The system of example 54 wherein the plurality of scraper shoes include soles that are co-planar with one another and vertically spaced beneath a plane in which a sole of the scraper base resides.

The present technology offers several advantages over traditional decarbonization systems and methods. For example, traditional decarbonizing takes places very sporadically, causing a large amount of deposits to build up on the oven floor and reducing coke plant efficiency and yield. The present technology provides for regular removal of coking deposits to allow coke production to continue, allow the coke plant to maintain a constant oven volume, and give the plant a higher coke yield. Moreover, by continuously decarbonizing the ovens, less thermal and mechanical stress is put on the coking equipment that would traditionally suffer a large amount of wear during the sporadic decarbonizing. Further, the continuous scraping systems described herein can cause uneven coke oven floors to become level and smooth for easier coal pushing.

From the foregoing it will be appreciated that, although specific embodiments of the technology have been described herein for purposes of illustration, various modifications may be made without deviating from the spirit and scope of the technology. For example, while several embodiments have been described in the context of loose, non-stamp-charged coal, in further embodiments, the decarbonization systems can be used in conjunction with stamp-charged coal. Additionally, while several embodiments describe the decarbonization performed on an oven floor, in further embodiments, other surfaces of the ovens, such as the walls, can be decarbonized. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A method of decarbonizing a coke oven of coking deposits, the method comprising:

processing a charge of coal in the coke oven, wherein the coke oven comprises a plurality of interior surfaces including a floor, a crown, and sidewalls that extend between the floor and the crown;

removing the charge from the coke oven with a pushing ram that extends horizontally through the coke oven from a coal inlet end of the coke oven to a coke outlet end of the coke oven; and removing coking deposits from the coke oven, while removing the charge from the coke oven, by scraping at least a portion of the coking deposits with a scraper that is coupled to the pushing ram; the scraper including an elongated scraper body extending perpendicular to a length of the coke oven during scraping and a plurality of elongated scraper shoes coupled to the scraper body so that the scraper shoes are horizontally spaced apart from one another and extending parallel to the length of the coke oven during scraping.

2. The method of claim 1 wherein removing coking deposits from the coke oven comprises simultaneously scraping at least a portion of the coking deposits from a plurality of the interior surfaces of the coke oven with a plurality of scrapers that are coupled to s-the-pushing ram.

3. The method of claim 1 wherein removing coking deposits from the coke oven comprises running a scraper along at least one interior surface of the coke oven a single time, whereby the scraper is pushed along a length of the coke oven and then retracted along the length of the coke oven.

4. The method of claim 1 wherein removing coking deposits from the coke oven comprises running a scraper over at least one interior surface of the coke oven a plurality of times.

5. The method of claim 4 wherein removing coking deposits from the coke oven comprises scraping the coking deposits with a scraper including at least one scraping feature that is comprised of a deformably resilient material such that the at least one scraping feature deforms from and returns to an original shape to substantially conform to a contour of at least one of the interior surfaces of the coke oven during scraping.

6. The method of claim 1 wherein removing coking deposits from the coke oven comprises scraping the coking deposits with a scraper comprised of steel, a steel alloy, or ceramics.

7. The method of claim 1 wherein removing coking deposits from the coke oven comprises scraping the coking deposits with a scraper comprised of an abrasive.

8. The method of claim 1 wherein removing coking deposits from the coke oven comprises scraping the coking deposits with a scraper operatively coupled to a pushing ram head of a pushing ram.

9. The method of claim 8 wherein a weight is operatively coupled with the pushing ram.

10. The method of claim 1 wherein removing coking deposits from the coke oven comprises scraping the coking deposits with a scraper operatively coupled to a pushing ram arm of a pushing ram.

11. The method of claim 10 wherein a weight is operatively coupled with the pushing ram.

12. The method of claim 1 wherein removing coking deposits from the coke oven comprises scraping coking deposits from a plurality of interior surfaces of the coke oven with a plurality of scrapers operatively coupled to a pushing ram.

13. The method of claim 1 wherein removing coking deposits from the coke oven comprises scraping the coking deposits with a scraper comprised of at least one deformably resilient scraping feature that substantially follows a contour of at least one of the interior surfaces of the coke oven during scraping.

14. The method of claim 13 wherein the at least one deformably resilient scraping feature includes at least one elongated scraping bar operatively coupled to a pushing ram with at least one resiliently deformable hinge such that a leading edge portion of the at least one elongated scraping bar is positioned adjacent to the at least one interior surface of the coke oven.

15. The method of claim 13 wherein the scraper includes a plurality of deformably resilient scraping features that substantially follow contours of a plurality of the interior surfaces of the coke oven during scraping.

16. The method of claim 1 wherein removing coking deposits from the coke oven comprises scraping the coking deposits with a plurality of scrapers operatively coupled with a pushing ram.

17. The method of claim 16 wherein the plurality of scrapers include at least two elongated scrapers operatively coupled with a pushing ram such that the elongated scrapers are positioned to be side by side one another with lengths of the scrapers extending perpendicular to a length of the coke oven during scraping.

18. The method of claim 17 wherein the elongated scrapers are positioned to be coaxially aligned with one another and horizontally spaced apart to define a gap between the elongated scrapers.

19. The method of claim 18 wherein the scraper includes a plurality of deformably resilient scraping features that extend outwardly from the elongated scrapers into the gap between the elongated scrapers.

20. The method of claim 19 wherein the plurality of deformably resilient scraping features from the adjacent elongated scrapers intermesh with one another in the gap between the elongated scrapers.

21. The method of claim 18 wherein the scraper includes a third elongated scraper operatively coupled with the pushing ram rearwardly from the at least two elongated scrapers and positioned so that a length of the third elongated scraper is behind the gap between the elongated scrapers to engage coking deposits that pass through the gap during scraping.

22. The method of claim 1 wherein removing coking deposits from the coke oven comprises scraping the coking deposits with a scraper including at least one scraping feature that is comprised of a deformably resilient material such that the at least one scraping feature deforms from and returns to an original shape to substantially conform to a contour of at least one of the interior surfaces of the coke oven during scraping.

23. The method of claim 1 wherein removing coking deposits from the coke oven comprises scraping the coking deposits from a plurality of different interior surfaces of the coke oven with a plurality of scrapers including at least one scraping feature that is comprised of a deformably resilient material such that the at least one scraping feature deforms from and returns to an original shape to substantially conform to a contour of at least one of the interior surfaces of the coke oven during scraping.

24. The method of claim 1 wherein removing coking deposits from the coke oven comprises scraping coking deposits on the floor of the coke oven wherein a flattened layer of coking deposits remains on the floor of the coking oven after scraping.

25. The method of claim 1 wherein removing coking deposits from the coke oven comprises scraping at least a portion of the coking deposits with a scraper operatively coupled to a pushing ram; the scraper including an elongated scraper body extending perpendicular to a length of the coke oven during scraping and a plurality of elongated scraper shoes coupled to the scraper body so that the scraper shoes are horizontally spaced apart from one another and extending parallel to the length of the coke oven during scraping.

26. The method of claim 1 wherein the plurality of scraper shoes include soles that are co-planar with one another and vertically spaced beneath a plane in which a sole of the scraper body resides, whereby a substantial portion of a scraper weight received by the coke oven floor is received beneath the soles of the scraper shoes during scraping.

27. The method of claim 26 wherein the plurality of scraper shoes are positioned along a length of the scraper body so that the scraper shoes are positioned above, and aligned with, sole flue walls beneath the oven coke floor during scraping.

* * * * *